US006527381B1

(12) United States Patent
Udagawa et al.

(10) Patent No.: US 6,527,381 B1
(45) Date of Patent: Mar. 4, 2003

(54) LIQUID CONTAINER, LIQUID EJECTION MECHANISM AND LIQUID EJECTION APPARATUS

(75) Inventors: Kenta Udagawa, Kawasaki (JP); Eiichiro Shimizu, Yokohama (JP); Shuzo Iwanaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/639,079

(22) Filed: Aug. 16, 2000

(30) Foreign Application Priority Data

Aug. 24, 1999 (JP) ..... 11-236782

(51) Int. Cl.[7] ..... B41J 2/175
(52) U.S. Cl. ..... 347/86
(58) Field of Search ..... 347/85, 86, 87; 222/187

(56) References Cited

U.S. PATENT DOCUMENTS

| | | | | |
|---|---|---|---|---|
| 5,453,771 A | | 9/1995 | Waseda et al. | 347/86 |
| 5,509,140 A | * | 4/1996 | Koitabashi et al. | 347/86 |
| 5,619,238 A | | 4/1997 | Higuma et al. | 347/86 |
| 6,012,808 A | | 1/2000 | Koitabashi et al. | 347/86 |
| 6,145,972 A | | 11/2000 | Udagawa et al. | 347/86 |
| 6,244,695 B1 | | 6/2001 | Udagawa | 347/86 |
| 6,382,786 B2 | * | 5/2002 | Iwanaga et al. | 347/86 |

FOREIGN PATENT DOCUMENTS

| | | | |
|---|---|---|---|
| EP | 624 475 | * | 11/1994 |
| EP | 640484 | | 3/1995 |
| EP | 691207 | | 1/1996 |
| EP | 791467 | | 8/1997 |
| EP | 845 362 | * | 6/1998 |
| EP | 845362 | | 6/1998 |
| GB | 2315461 | | 2/1998 |
| JP | 6-015839 | | 1/1994 |
| JP | 6-040043 | | 2/1994 |
| JP | 7-125232 | | 5/1995 |
| JP | 9-174867 | | 7/1997 |

* cited by examiner

*Primary Examiner*—Michael Nghiem
(74) *Attorney, Agent, or Firm*—Fitzpatrick, Cella, Harper & Scinto

(57) ABSTRACT

A liquid container has a negative pressure generating member containing chamber receiving a negative pressure generating member formed with a fibrous material and having a liquid supply portion and an atmosphere communicating portion, a liquid containing chamber forming a substantially enclosed space having a communicating portion communicating with the negative pressure generating member containing chamber and storing a liquid to be supplied to the negative pressure generating member, and a partition wall separating the negative pressure generating member containing chamber and the liquid containing chamber and formed with the communicating portion. The liquid container also includes an atmospheric air introducing mechanism provided in the partition wall on the side of the negative pressure generating member containing chamber, in communication with the communicating portion, and a projecting portion in a part of the atmospheric air introducing mechanism projecting on the side of the negative pressure generating member containing chamber.

12 Claims, 21 Drawing Sheets

LIQUID CONTAINER, LIQUID EJECTION MECHANISM AND LIQUID EJECTION APPARATUS

This application is based on Japanese Patent Application No. 11-236782 (1999) filed Aug. 24, 1999, the content of which is incorporated hereinto by reference.

BACKGROUND OF THE INVENTION

1. Field of the Invention

The present invention relates to a liquid container capable of maintaining a supply ability of ink, a liquid ejection mechanism employing the liquid container and a liquid ejection apparatus.

It should be noted that the present invention is applicable not only for a typical printing apparatus but also for a copy machine, a facsimile having a communication system, a wordprocessor having a printing portion, and so on, and further for an industrial printing apparatus composed with various processing systems.

2. Description of the Related Art

In general, a liquid container serving as an ink tank in a printing apparatus to be used in a field of an ink jet apparatus, is provided with a construction for adjusting a holding force of ink stored in the ink tank in order to satisfactorily perform ink supply for a printing head for ejecting the ink. This holding force is referred to as negative pressure since a pressure of an ink ejecting portion of the printing head becomes negative relative to an atmospheric pressure. (Such a member for generating the negative pressure will be hereinafter referred to as a negative pressure generating member.)

One of the easiest method for generating such negative pressure is to provide an ink absorbing body, such as a porous body including a urethane foam, felt and the like, within the ink tank to utilize capillary phenomenon (ink absorbing force) of the ink absorbing body.

For example, Japanese Patent Application Laid-open No. 6-15839 (1994) discloses a construction with choking up a plurality of ink absorbing bodies having mutually different density in the order of a high density absorbing body and a low density absorbing body toward a supply passage, over the entire tank, within the ink tank. The high density absorbing body has a longer total length of fiber per unit volume to have higher ink absorption capability, an d the low density absorbing body has a shorter total length of fiber per unit volume to have lower ink absorption capability. Joints between fibers are fitted under pressure so as to prevent interruption of ink due to admixing of air.

On the other hand, commonly owned Japanese Patent Application Laid-open Nos. 7-125232 (1995) and 6-40043 (1994) have proposed an ink tank having a liquid containing chamber which can increase an ink storage capacity per unit volume of the ink tank while the ink absorbing body is used and can realize stable ink supply.

In FIGS. 14A and 14B, shown are structural cross sections of the ink tank using the construction set forth above. As shown, ink tank 10 defines two spaces separated by a partition wall 13 serving as a separator wall provided with a communicating portion 20, such as a communication hole. One space is a liquid containing chamber 12 being enclosed except for the communicating portion 20 of the partition wall 13 and directly holding ink. The other space forms a negative pressure generating member containing chamber 11 housing a negative pressure generating member 30. In a wall surface forming the negative pressure generating member containing chamber 11, an atmosphere communicating portion 14, such as an atmosphere communication hole, for introducing atmospheric air into the container according to consumption of the ink, and a supply opening 16 having a pressure contact body 15 serving as ink leading member to a recording head not shown, are formed.

In FIG. 14A, a region where the negative pressure generating member holds the ink is shown by black dotted portion. On the other hand, the ink stored in the space is shown by cross-hatched portion. In order to prevent introduction of atmospheric air into the liquid containing chamber 12 through portions other than the atmosphere communication portion 14, the negative pressure generating member 30 is required to be tightly fitted onto the inner peripheral wall of the negative pressure generating member containing chamber 11.

Such ink tank achieving both of compact sizing and a high usage efficiency has been marketed by the assignee of the present invention and has been practically used. In the example shown in FIG. 14A, the pressure contact body 15 having a higher capillary force and a higher physical strength than the negative pressure generating member 30, is provided in the supply opening 16. The pressure contact body 15 is in contact with the negative pressure generating member 30 under pressure. In the vicinity of the communicating portion 20 between the negative pressure generating body containing chamber 11 and the liquid containing chamber 12, an atmospheric air introduction groove 21 is provided in order to promote introduction of the atmospheric air into the liquid containing chamber 12. In the vicinity of the atmosphere communicating portion, a space where no negative pressure generating member is present, namely a buffer chamber 18 is defined by means of a rib 17.

However, the construction set forth above is premised on that a urethane foam is used as the negative pressure generating member. If the negative pressure generating member formed of fiber with maintaining the same shape, density distribution of the negative pressure generating member can be differentiated due to difference of elasticity and hardness thereof.

In certain density distribution, stable gas/liquid exchange can be disturbed to possibly cause failure of ink supply in spite of the fact that the ink is remained in the ink tank.

Therefore, the inventors have made an extensive study for the density distribution in the vicinity of the atmospheric air introduction groove. As a result, it has been found the following problems.

Namely, as shown in FIG. 15A, when the negative pressure generating member 30 in the peripheral portion 50 of the atmospheric air introducing groove 21 has higher density than that of other portion, a capillary force to be generated becomes higher so that the ink can be held in the vicinity of the negative pressure generating member 30 being in contact with the atmospheric air introducing groove 21 even when the ink is consumed so as not to be introduced into the communicating portion 20. As a result, gas/liquid exchange is not initiated (FIG. 15B) or even if initiated, since the strength of the negative pressure upon gas/liquid exchange is determined by the portion 50 contacting with the atmospheric air introducing groove 21 of the negative pressure generating member 30, negative pressure becomes strong. Then, most of the ink in the negative pressure generating member 30 can be consumed out before all of the ink within the liquid containing chamber 12 is consumed, resulting in interrupting an ink passage from the liquid containing chamber 12 to the ink supply opening 15. It has been found that once the ink passage is interrupted, failure of ink supply can be caused.

The conventional atmospheric air introduction groove is formed into a buffer structure by providing a groove in a portion recessed in the partition wall. The density of the portion of the negative pressure generating member 30 in contact with the grooved portion is designed to be higher than the density of the portion in contact with the partition wall. In the case of the negative pressure generating member formed with a urethane foam, since the urethane foam has an appropriate elasticity, even when the urethane foam of the size greater than the volume of the negative pressure generating member containing chamber 11 is inserted thereinto to enhance tight contact with side walls, the urethane foam is compressed relatively uniformly so as not to cause substantial difference of density distribution.

However, the negative pressure generating member formed of fiber has low elasticity, particularly has little elasticity in the longitudinal direction of the fiber. Therefore, it has been found that density of the negative pressure generating member is increased in the portion contacting with the atmospheric air introducing groove by pressure contact of the negative pressure generating member to the partition wall.

It may eliminate increasing of the density of the portion 50 in the vicinity of the atmospheric air introducing groove by employing a structure advanced from the conventional buffer structure. However, it is possible that a large gap is formed in the buffer structure portion 51 due to tolerance of dimension of the negative pressure generating member 30 in a direction perpendicular to the partition wall 13.

If such a large gap is formed in the atmospheric air introducing portion 50, bubbles in the atmospheric air introducing portion 50 separated from the negative pressure generating member 30 can be aggregated in the gap to form a large bubble 52. The large bubble 52 can interfere flow of the air from the negative pressure generating member 30 to the liquid containing chamber 12. As a result, failure of ink supply can be caused.

On the other hand, when the negative pressure generating member 30 is inserted into the chamber 11 from the above, the negative pressure generating member 30 is expanded in greater extent at the buffer structure portion to cause difficulty in assuring tight contact with the bottom surface of the chamber 11.

The foregoing problem has not raise significant problem in the case of the ink tank employing the conventional urethane foam since difference of density distribution is hardly caused.

SUMMARY OF THE INVENTION

Accordingly, it is an object of the present invention to provide a liquid container, a liquid ejecting mechanism and a liquid ejection apparatus which can solve the problems set forth above with employing a negative pressure absorbing body formed with fiber and assure stable ink supply performance.

In the first aspect of the present invention, there is provided a liquid container comprising:

a negative pressure generating member containing chamber receiving a negative pressure generating member formed with a fibrous material and having a liquid supply portion and an atmosphere communicating portion;

a liquid containing chamber forming a substantially enclosed space having a communicating portion communicating with the negative pressure generating member containing chamber and storing a liquid to be supplied to the negative pressure generating member;

a partition wall separating the negative pressure generating member containing chamber and the liquid containing chamber and formed with the communicating portion;

an atmospheric air introducing mechanism in the form of a recess provided in the partition wall on the side of the negative pressure generating member containing chamber, in communication with the communicating portion; and a projecting portion, provided in a part of the atmospheric air introducing mechanism, projecting on the side of the negative pressure generating member containing chamber.

The atmospheric air introducing mechanism may have a recessed portion buffering pressure contact of the negative pressure generating member onto the partition wall and a projecting portion improving workability in assembling the negative pressure generating member.

The atmospheric air introducing mechanism may include a plurality of vertically extending grooves through the recessed portion and the projecting portion.

The projecting portion may be provided at a lower portion of the atmospheric air introducing mechanism.

The projecting portion may be lower than a wall surface of the partition wall on the side of the negative pressure generating member containing chamber.

The communicating portion of the partition wall may be partly chamfered on the side of the negative pressure generating member containing chamber.

A part of the atmospheric pressure introducing mechanism may be tube-shaped.

The negative pressure generating member formed with fibrous material may be formed by stacking fibrous bodies with substantially the same directionality, and a direction of fiber may intersect with the partition wall.

The fibrous material may be olefin type resin fiber.

In the second aspect of the present invention, there is provided a liquid ejecting mechanism comprising:

a liquid container including:

- a negative pressure generating member containing chamber housing a negative pressure generating member formed with fibrous material and having a liquid supply portion and an atmosphere communicating portion;
- a liquid containing chamber forming a substantially enclosed space with a communicating portion communicated with the negative pressure generating member containing chamber and storing a liquid to be supplied to the negative pressure generating member; and
- a partition wall separating the negative pressure generating member containing chamber and the liquid containing chamber and formed with the communicating portion; and liquid ejecting means, receiving supply of the liquid from the liquid container, for performing printing, wherein the liquid ejecting mechanism further comprises:

- an atmospheric air introducing mechanism in the form of a recess provided in the partition wall on the side of the negative pressure generating member containing chamber, in communication with the communicating portion; and
- a projecting portion, provided in a part of the atmospheric air introducing mechanism, projecting on the side of the negative pressure generating member containing chamber.

In the third aspect of the present invention, there is provided a liquid ejecting mechanism comprising:

a liquid container comprising:

a negative pressure generating member containing chamber housing a negative pressure generating member formed with fibrous material and having a liquid supply portion and an atmosphere communicating portion;

a liquid containing chamber forming a substantially enclosed space with a communicating portion communicated with the negative pressure generating member containing chamber and storing a liquid to be supplied to the negative pressure generating member; and a partition wall separating the negative pressure generating member containing chamber and the liquid containing chamber and formed with the communicating portion;

liquid ejecting means, receiving supply of the liquid from the liquid. container, for performing printing, and wherein the liquid ejecting mechanism further comprising:

an atmospheric air introducing mechanism communicating with the communicating portion and formed in the partition wall on the side of the negative pressure generating member containing chamber, the atmospheric air introducing mechanism including a recessed portion buffering pressure contact of the negative pressure generating member onto the partition wall and a projecting portion improving workability in assembling of the negative pressure generating member.

In the fourth aspect of the present invention, there is provided a liquid ejecting apparatus comprising:

a liquid ejecting mechanism having:

a liquid container including:

a negative pressure generating member containing chamber housing a negative pressure generating member formed with fibrous material and having a liquid supply portion and an atmosphere communicating portion;

a liquid containing chamber forming a substantially enclosed space with a communicating portion communicated with the negative pressure generating member containing chamber and storing a liquid to be supplied to the negative pressure generating member; and a partition wall separating the negative pressure generating member containing chamber and the liquid containing chamber and formed with the communicating portion;

liquid ejecting means, receiving supply of the liquid from the liquid container, for performing printing, a carriage mechanism to be scanned with carrying the liquid ejecting mechanism, wherein the liquid container further comprising:

an atmospheric air introducing mechanism in the form of a recess communicating with the communicating portion and formed in the partition wall on the side of the negative pressure generating member containing chamber; and a projecting portion provided in a part of the atmospheric air introducing mechanism and projecting on the side of the negative pressure generating member containing chamber.

In the fifth aspect of the present invention, there is provided a liquid ejecting apparatus comprising:

a liquid ejecting mechanism having:

a liquid container including:

a negative pressure generating member containing chamber housing a negative pressure generating member formed with fibrous material and having a liquid supply portion and an atmosphere communicating portion;

liquid containing chamber forming a substantially enclosed space with a communicating portion communicated with the negative pressure generating member containing chamber and storing a liquid to be supplied to the negative pressure generating member; and a partition wall separating the negative pressure generating member containing chamber and the liquid containing chamber and formed with the communicating portion;

liquid ejecting means, receiving supply of the liquid from the liquid container, for performing printing, a carriage mechanism to be scanned with carrying the liquid ejecting mechanism, wherein the liquid container further comprising:

an atmospheric air introducing mechanism communicating with the communicating portion and formed in the partition wall on the side of the negative pressure generating member containing chamber, the atmospheric air introducing mechanism including a recessed portion buffering pressure contact of the negative pressure generating member onto the partition wall and a projecting portion improving workability in assembling the negative pressure generating member.

With the liquid container, the liquid ejection mechanism and the liquid ejection apparatus of the present invention constructed as set forth above, the upper portion of the atmospheric air introducing mechanism of the liquid container is formed into the buffer structure, and a projecting portion is provided as a part of the atmospheric air introducing mechanism so as to restrict increasing of :density of the portion contributing for gas/liquid exchange by the buffer structure, and also to restrict accumulation of a bubble by the projecting portion. At the same time, the projecting portion also serves as a guide structure for insertion into the receptacle chamber upon assembling of the negative pressure generating member. Furthermore, since the buffer structure is formed by providing the atmospheric air introducing groove at a position recessed from the surface of the partition wall, both sides of the negative pressure generating member are in contact with the surface of the partition wall, permitting a portion of the negative pressure generating member opposing to the atmospheric air introducing groove to freely expand, so that the atmospheric air introducing groove in the recessed position successfully prevents a large bubble from being formed with bubbles released from the negative pressure generating member being aggregated. On the other hand, the projecting portion at the lower portion acts for returning the portion of the negative pressure generating member once expanded upon insertion to the position near the height of the surface of the partition wall and for separating small bubbles from each other so as not to form a large bubble.

With the construction set forth above, abrupt increasing of density is hardly caused in the vicinity of the gas/liquid exchange groove or the atmospheric air introducing groove. Small bubbles released from the negative pressure generating member is unlikely to aggregate to form a large bubble to stablly flow into the liquid containing chamber with maintaining a small bubble state. Furthermore, in the assembling step of the liquid container, a stable negative pressure generating member insertion condition without curling up or floating can be obtained.

The above and other objects, effects, features, and advantages of the present invention will become more apparent from the following description of embodiments thereof taken in conjunction with the accompanying drawings.

BRIEF DESCRIPTION OF THE DRAWINGS

FIGS. 11A and 11B are fragmentary explanatory illustration showing the first embodiment of an ink tank in a printing apparatus according to the present invention, in which FIG. 11A is a longitudinal section of the ink tank, and FIG. 11B is a perspective view of an atmospheric air introducing portion;

FIGS. 14A and 14B are general explanatory illustration of an ink tank in the conventional printer, in which FIG. 14A is a longitudinal section of the ink tank for explaining an ink supply operation in the ink tank, and FIG. 11B is a similar longitudinal section showing supply failure;

FIGS. 15A and 15B are general explanatory illustration showing an ink tank in the conventional printer, in which FIG. 15A is a longitudinal section of the ink tank for. explaining supply failure possibly caused upon ink supply in the ink tank and FIG. 15B is a similar longitudinal section showing the supply failure.

DETAILED DESCRIPTION OF PREFERRED EMBODIMENT

Embodiments of the printing apparatus according to the present invention will be described by referring to the accompanying drawings.

In the following description we take up as an example a printing apparatus using an ink jet printing system.

In this specification, a word "print" (or "record") refers to not only forming significant information, such as characters and figures, but also forming images, designs or patterns on printing medium and processing media, whether the information is significant or insignificant or whether it is visible so as to be perceived by humans.

The word "print medium" or "print sheet" include not only paper used in common printing apparatus, but cloth, plastic films, metal plates, glass, ceramics, wood, leather or any other material that can receive ink. This word will be also referred to "paper".

Further, the word "ink" (or "liquid") should be interpreted in its wide sense as with the word "print" and refers to liquid that is applied to the printing medium to form images, designs or patterns, process the printing medium or process ink (for example, coagulate or make insoluble a colorant in the ink applied to the printing medium).

1. Apparatus Body

Figure 1:
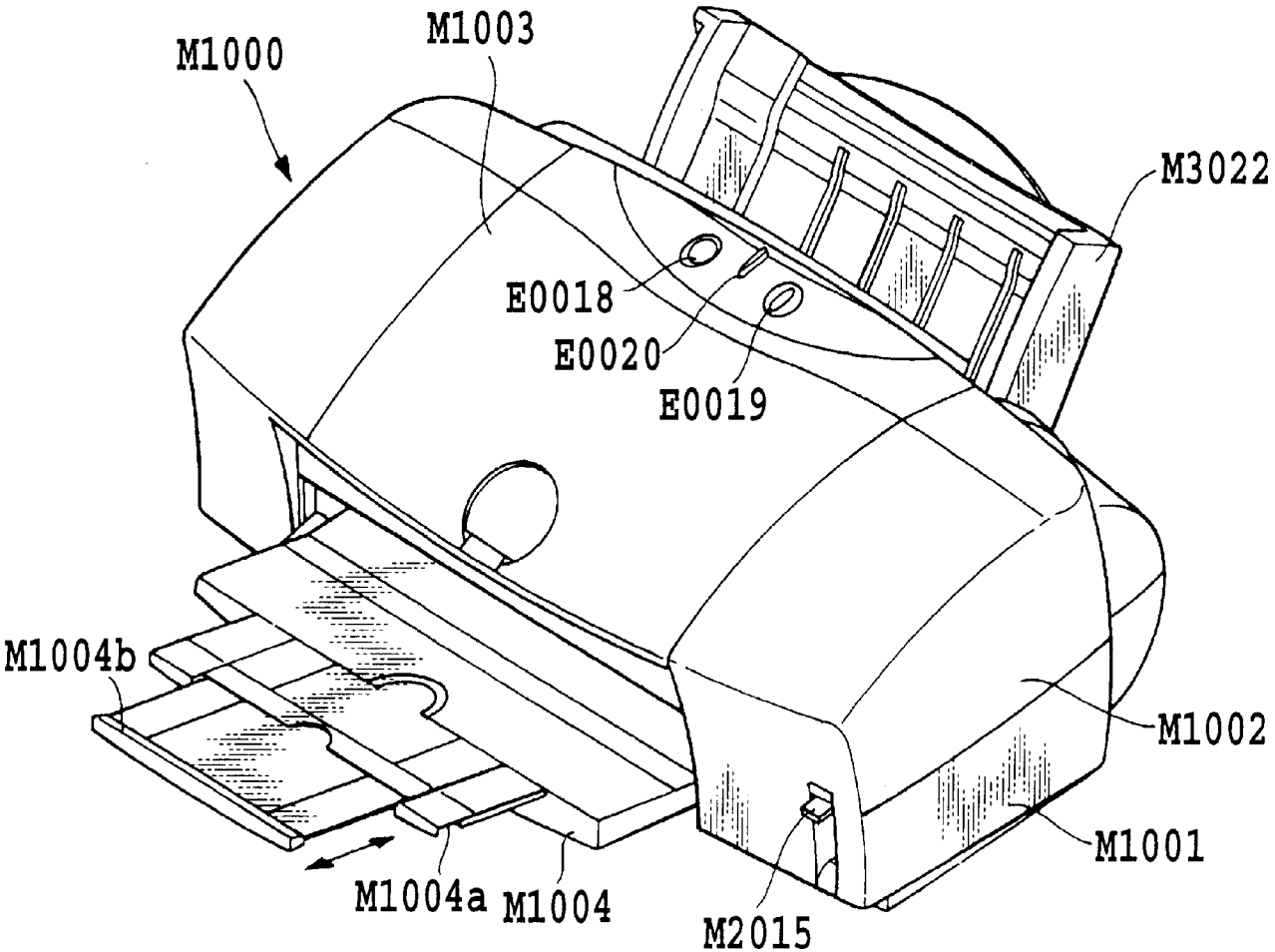
FIG. 1 is a perspective view showing an external construction of an ink jet printer as one embodiment of the present invention.
Figure 2:
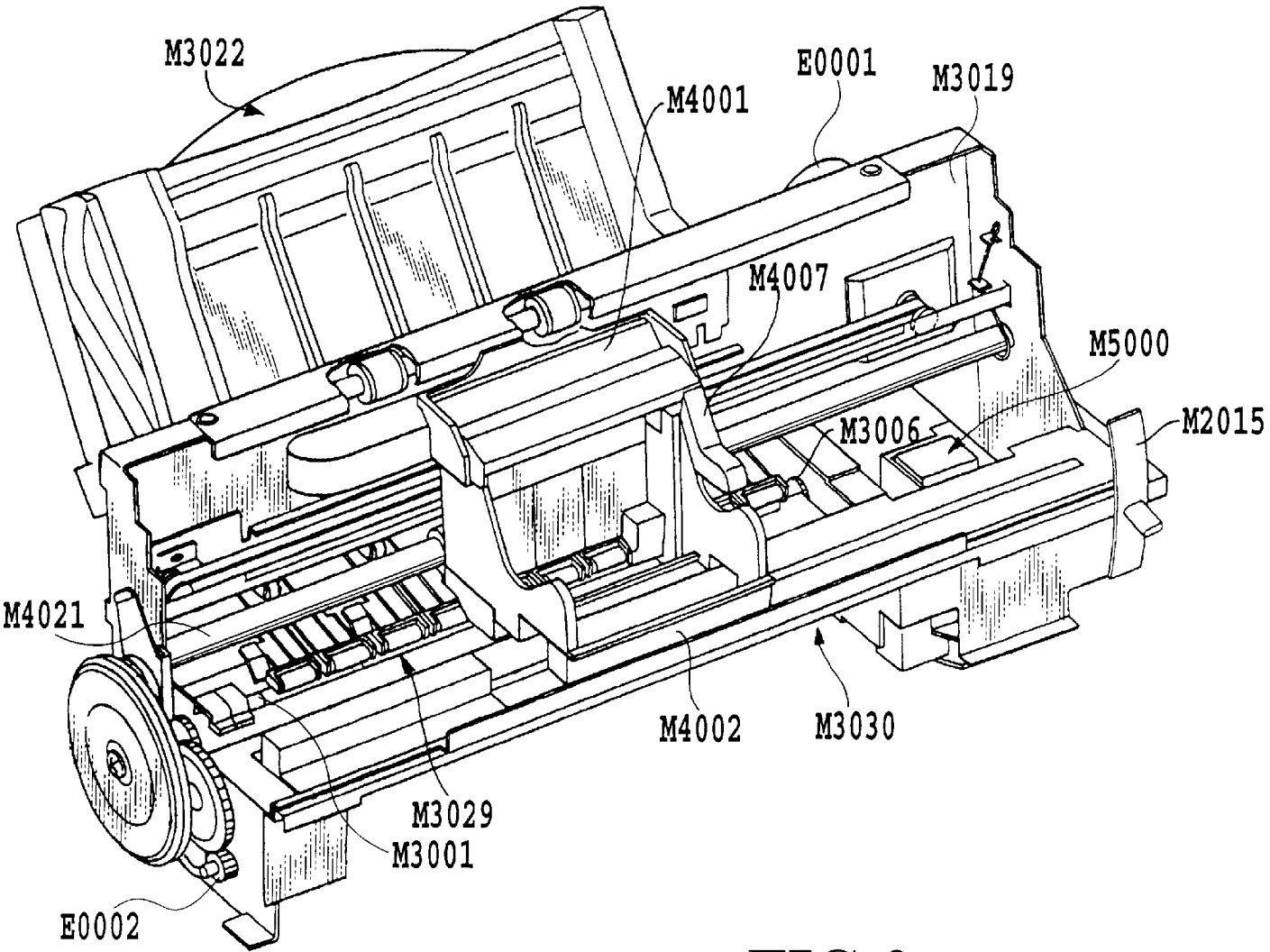
FIG. 2 is a perspective view showing the printer of FIG. 1 with an enclosure member removed.

FIGS. 1 and 2 show an outline construction of a printer using an ink jet printing system. In FIG. 1, a housing of a printer body M1000 of this embodiment has an enclosure member, including a lower case M1001, an upper case M1002, an access cover M1003 and a discharge tray M1004, and a chassis M3019 (see FIG. 2) accommodated in the enclosure member.

The chassis M3019 is made of a plurality of plate-like metal members with a predetermined rigidity to form a skeleton of the printing apparatus and holds various printing operation mechanisms described later.

The lower case M1001 forms roughly a lower half of the housing of the printer body M1000 and the upper case M1002 forms roughly an upper half of the printer body M1000. These upper and lower cases, when combined, form a hollow structure having an accommodation space therein to accommodate various mechanisms described later. The printer body M1000 has an opening in its top portion and front portion.

The discharge tray M1004 has one end portion thereof rotatably supported on the lower case M1001. The discharge tray M1004, when rotated, opens or closes an opening formed in the front portion of the lower case M1001. When the print operation is to be performed, the discharge tray M1004 is rotated forwardly to open the opening so that printed sheets can be discharged and successively stacked. The discharge tray M1004 accommodates two auxiliary trays M1004*a*, M1004*b*. These auxiliary trays can be drawn out forwardly as required to expand or reduce the paper support area in three steps.

The access cover M1003 has one end portion thereof rotatably supported on the upper case M1002 and opens or closes an opening formed in the upper surface of the upper case M1002. By opening the access cover M1003, a print head cartridge H1000 or an ink tank H1900 installed in the body can be replaced. When the access cover M1003 is opened or closed, a projection formed at the back of the access cover, not shown here, pivots a cover open/close lever. Detecting the pivotal position of the lever as by a micro-switch and so on can determine whether the access cover is open or closed.

At the upper rear surface of the upper case M1002 a power key E0018, a resume key E0019 and an LED E0020 are provided. When the power key E0018 is pressed, the LED E0020 lights up indicating to an operator that the apparatus is ready to print. The LED E0020 has a variety of display functions, such as alerting the operator to printer troubles as by changing its blinking intervals and color. Further, a buzzer E0021 (FIG. 7) may be sounded. When the trouble is eliminated, the resume key E0019 is pressed to resume the printing.

2. Printing Operation Mechanism

Next, a printing operation mechanism installed and held in the printer body M1000 according to this embodiment will be explained.

The printing operation mechanism in this embodiment comprises: an automatic sheet feed unit M3022 to automatically feed a print sheet into the printer body; a sheet transport unit M3029 to guide the print sheets, fed one at a time from the automatic sheet feed unit, to a predetermined print position and to guide the print sheet from the print position to a discharge unit M3030; a print unit to perform a desired printing on the print sheet carried to the print position; and an ejection performance recovery unit M5000 to recover the ink ejection performance of the print unit.

Here, the print unit will be described. The print unit comprises a carriage M4001 movably supported on a carriage shaft M4021 and a print head cartridge H1000 removably mounted on the carriage M4001.

2.1 Print Head Cartridge

First, the print head cartridge used in the print unit will be described with reference to FIGS. 3 to 5.

Figure 3:
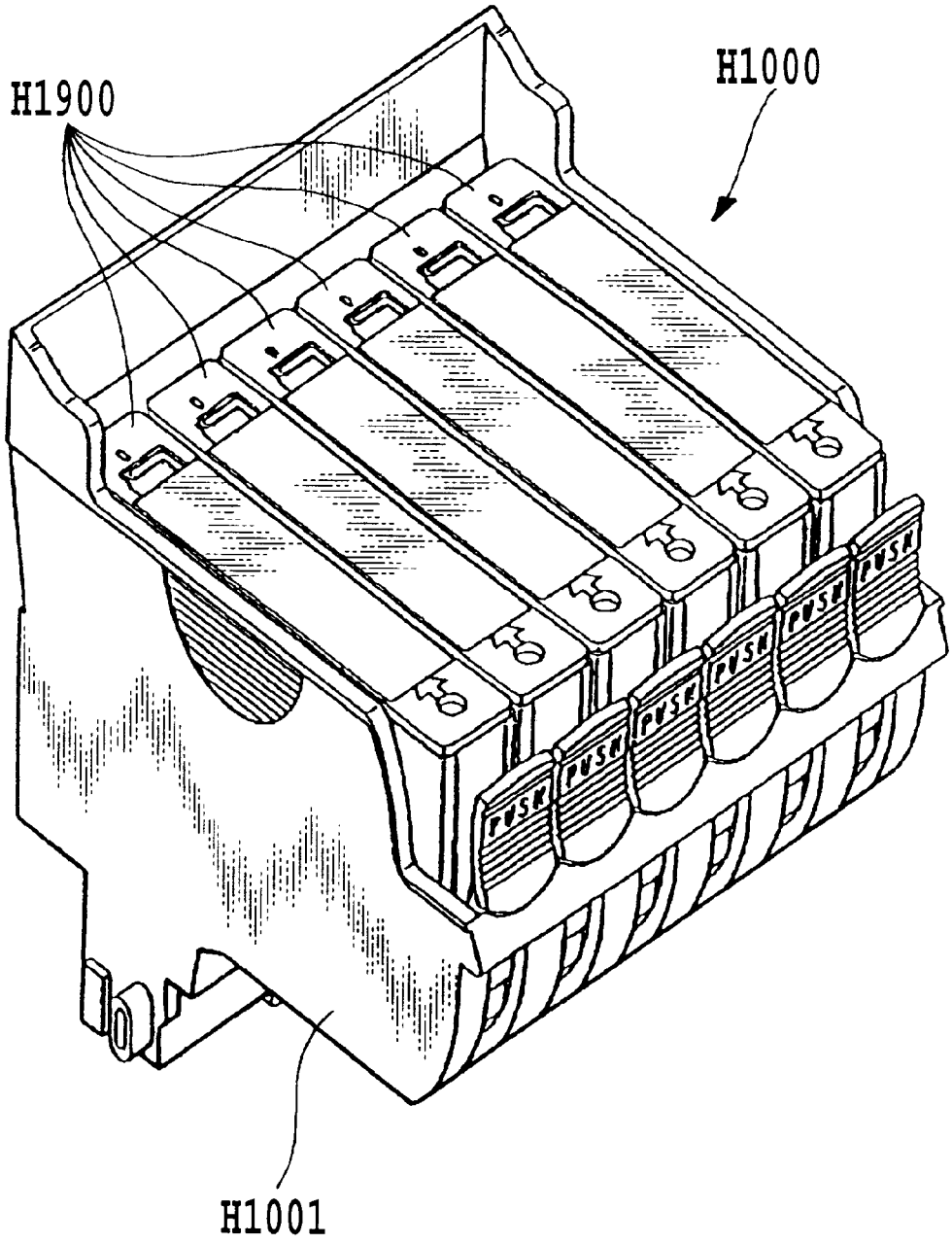
FIG. 3 is a perspective view showing an assembled print head cartridge used in the printer of one embodiment of the present invention.
Figure 4:
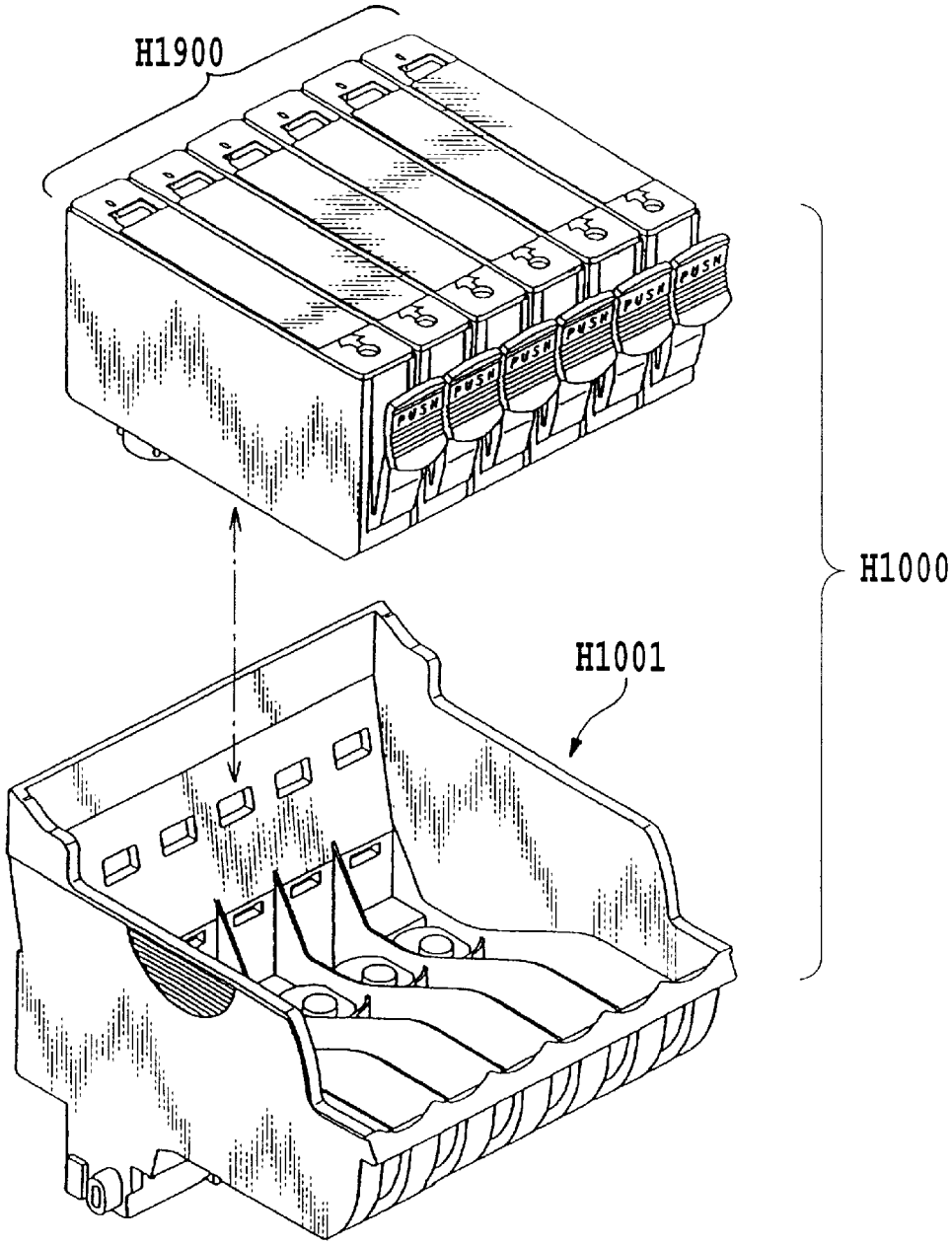
FIG. 4 is an exploded perspective view showing the print head cartridge of FIG. 3.

The print head cartridge H1000 in this embodiment, as shown in FIG. 3, has an ink tank H1900 containing inks and a print head H1001 for ejecting ink supplied from the ink tank H1900 out through nozzles according to print information. The print head H1001 is of a so-called cartridge type in which it is removably mounted to the carriage M4001 described later.

The ink tank for this print head cartridge H1000 consists of separate ink tanks H1900 of, for example, black, light cyan, light magenta, cyan, magenta and yellow to enable color printing with as high an image quality as photograph. As shown in FIG. 4, these individual ink tanks are removably mounted to the print head H1001.

Figure 5:
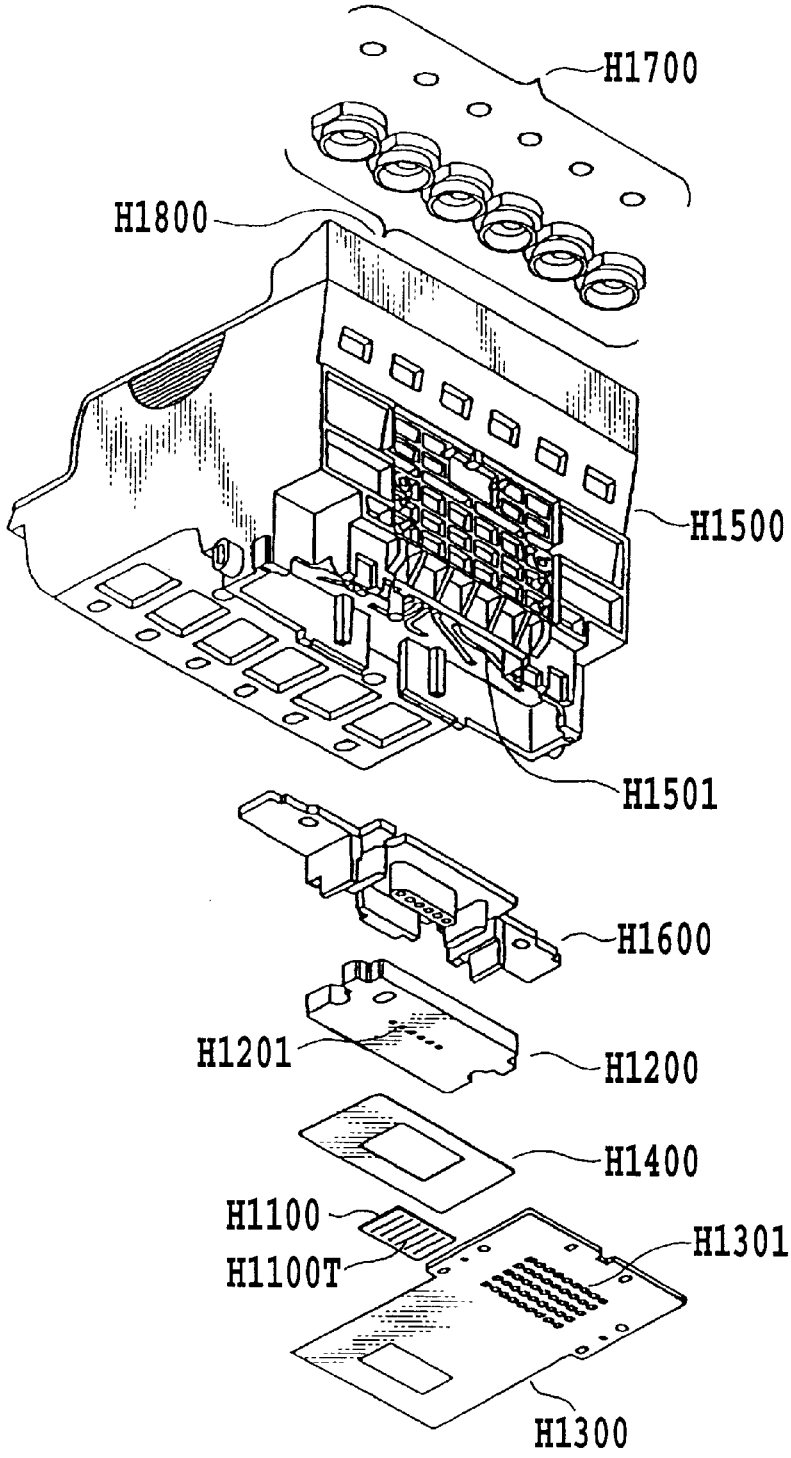
FIG. 5 is an exploded perspective view of the print head of FIG. 4 as seen diagonally below.

Then, the print head H1001, as shown in the perspective view of FIG. 5, comprises a print element substrate H1100, a first plate H1200, an electric wiring board H1300, a second plate H1400, a tank holder H1500, a flow passage forming member H1600, a filter H1700 and a seal rubber H1800.

The print element silicon substrate H1100 has formed in one of its surfaces, by the film deposition technology, a plurality of print elements to produce energy for ejecting ink and electric wires, such as aluminum, for supplying electricity to individual print elements. A plurality of ink passages and a plurality of nozzles H1100T, both corresponding to the print elements, are also formed by the photolithography technology. In the back of the print element substrate H1100, there are formed ink supply ports for supplying ink to the plurality of ink passages. The print element substrate H1100 is securely bonded to the first plate H1200 which is formed with ink supply ports H1201 for supplying ink to the print element substrate H1100. The first plate H1200 is securely bonded with the second plate H1400 having an opening. The second plate H1400 holds the electric wiring board H1300 to electrically connect the electric wiring board H1300 with the print element substrate H1100. The electric wiring board H1300 is to apply electric signals for ejecting ink to the print element substrate H1100, and has electric wires associated with the print element substrate H1100 and external signal input terminals H1301 situated at electric wires' ends for receiving electric signals from the printer body. The external signal input terminals H1301 are positioned and fixed at the back of a tank holder H1500 described later.

The tank holder H1500 that removably holds the ink tank H1900 is securely attached, as by ultrasonic fusing, with the flow passage forming member H1600 to form an ink passage H1501 from the ink tank H1900 to the first plate H1200. At the ink tank side end of the ink passage H1501 that engages with the ink tank H1900, a filter H1700 is provided to prevent external dust from entering. A seal rubber H1800 is provided at a portion where the filter H1700 engages the ink tank H1900, to prevent evaporation of the ink from the engagement portion.

As described above, the tank holder unit, which includes the tank holder H1500, the flow passage forming member H1600, the filter H1700 and the seal rubber H1800, and the print element unit, which includes the print element substrate H1100, the first plate H1200, the electric wiring board H1300 and the second plate H1400, are combined as by adhesives to form the print head H1001.

2.2 Carriage

Next, by referring to FIG. 2, the carriage M4001 carrying the print head cartridge H1000 will be explained.

As shown in FIG. 2, the carriage M4001 has a carriage cover M4002 for guiding the print head H1001 to a predetermined mounting position on the carriage M4001, and a head set lever M4007 that engages and presses against the tank holder H1500 of the print head H1001 to set the print head H1001 at a predetermined mounting position.

That is, the head set lever M4007 is provided at the upper part of the carriage M4001 so as to be pivotable about a head set lever shaft. There is a spring-loaded head set plate (not shown) at an engagement portion where the carriage M4001 engages the print head H1001. With the spring force, the head set lever M4007 presses against the print head H1001 to mount it on the carriage M4001.

At another engagement portion of the carriage M4001 with the print head H1001, there is provided a contact flexible printed cable (see FIG. 7: simply referred to as a contact FPC hereinafter) E0011 whose contact portion electrically contacts a contact portion (external signal input terminals) H1301 provided in the print head H1001 to transfer various information for printing and supply electricity to the print head H1001.

Between the contract portion of the contact FPC E0011 and the carriage M4001 there is an elastic member not shown, such as rubber. The elastic force of the elastic member and the pressing force of the head set lever spring combine to ensure a reliable contact between the contact portion of the contact FPC E0011 and the carriage M4001. Further, the contact FPC E0011 is connected to a carriage substrate E0013 mounted at the back of the carriage M4001 (see FIG. 7).

3. Scanner

The printer of this embodiment can mount a scanner in the carriage M4001 in place of the print head cartridge H1000 and be used as a reading device.

The scanner moves together with the carriage M4001 in the main scan direction, and reads an image on a document fed instead of the printing medium as the scanner moves in the main scan direction. Alternating the scanner reading operation in the main scan direction and the document feed in the sub-scan direction enables one page of document image information to be read.

Figures 6A, 6B:
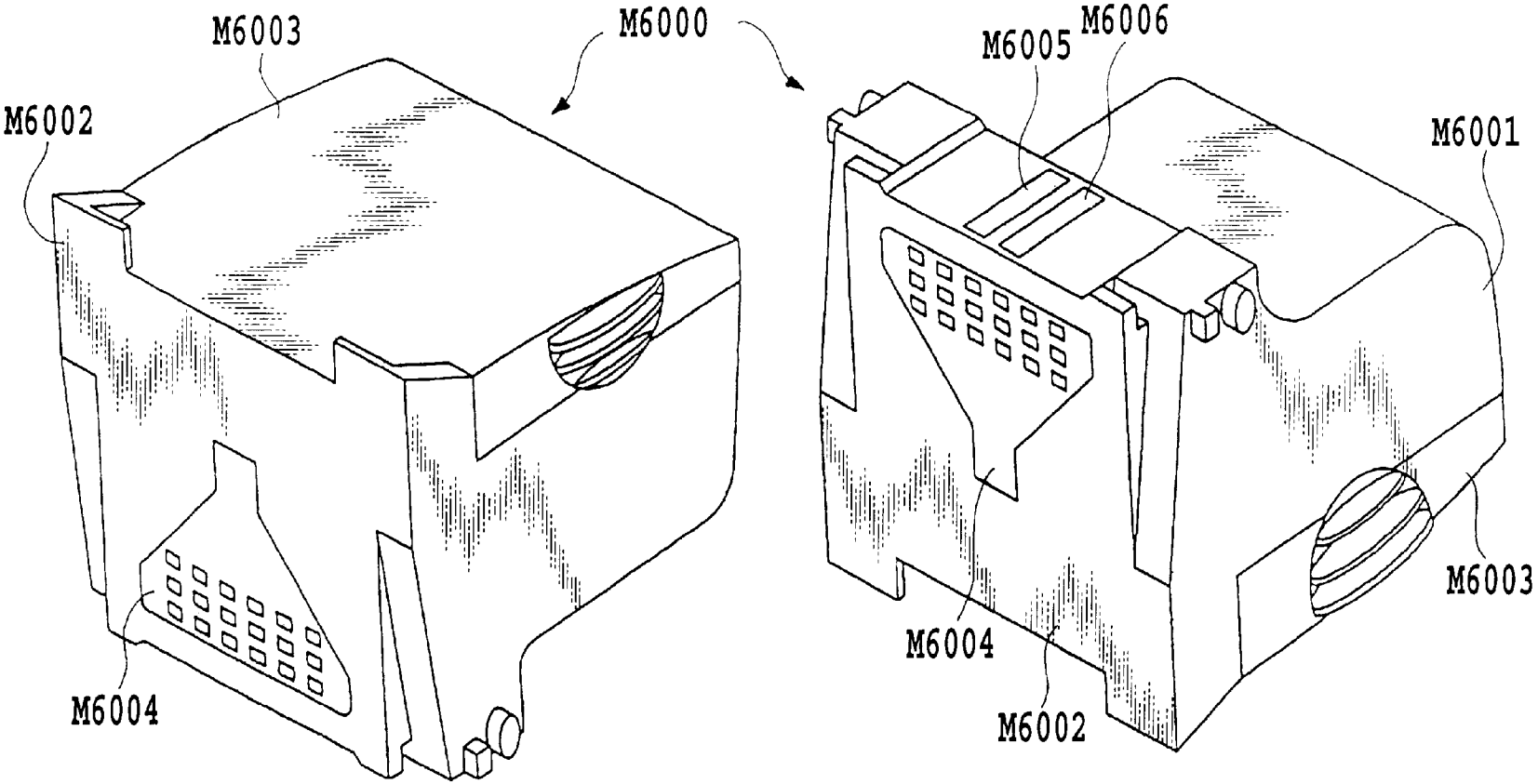
FIGS. 6A and 6B are perspective views showing a construction of a scanner cartridge upside down which can be mounted in the printer of one embodiment of the present invention instead of the print head cartridge of FIG. 3.

FIGS. 6A and 6B show the scanner M6000 upside down to explain about its outline construction.

As shown in the figure, a scanner holder M6001 is shaped like a box and contains an optical system and a processing circuit necessary for reading. A reading lens M6006 is provided at a portion that faces the surface of a document when the scanner M6000 is mounted on the carriage M4001. The lens M6006 focuses light reflected from the document surface onto a reading unit inside the scanner to read the document image. An illumination lens M6005 has a light source not shown inside the scanner. The light emitted from the light source is radiated onto the document through the lens M6005.

The scanner cover M6003 secured to the bottom of the scanner holder M6001 shields the interior of the scanner holder M6001 from light. Louver-like grip portions are provided at the sides to improve the ease with which the scanner can be mounted to and dismounted from the carriage M4001. The external shape of the scanner holder M6001 is almost similar to that of the print head H1001, and the scanner can be mounted to or dismounted from the carriage M4001 in a manner similar to that of the print head H1001.

The scanner holder M6001 accommodates a substrate having a reading circuit, and a scanner contact PCB M6004 connected to this substrate is exposed outside. When the scanner M6000 is mounted on the carriage M4001, the scanner contact PCB M6004 contacts the contact FPC E0011 of the carriage M4001 to electrically connect the substrate to a control system on the printer body side through the carriage M4001.

4. Example Configuration of Printer Electric Circuit

Next, an electric circuit configuration in this embodiment of the invention will be explained.

Figure 7:
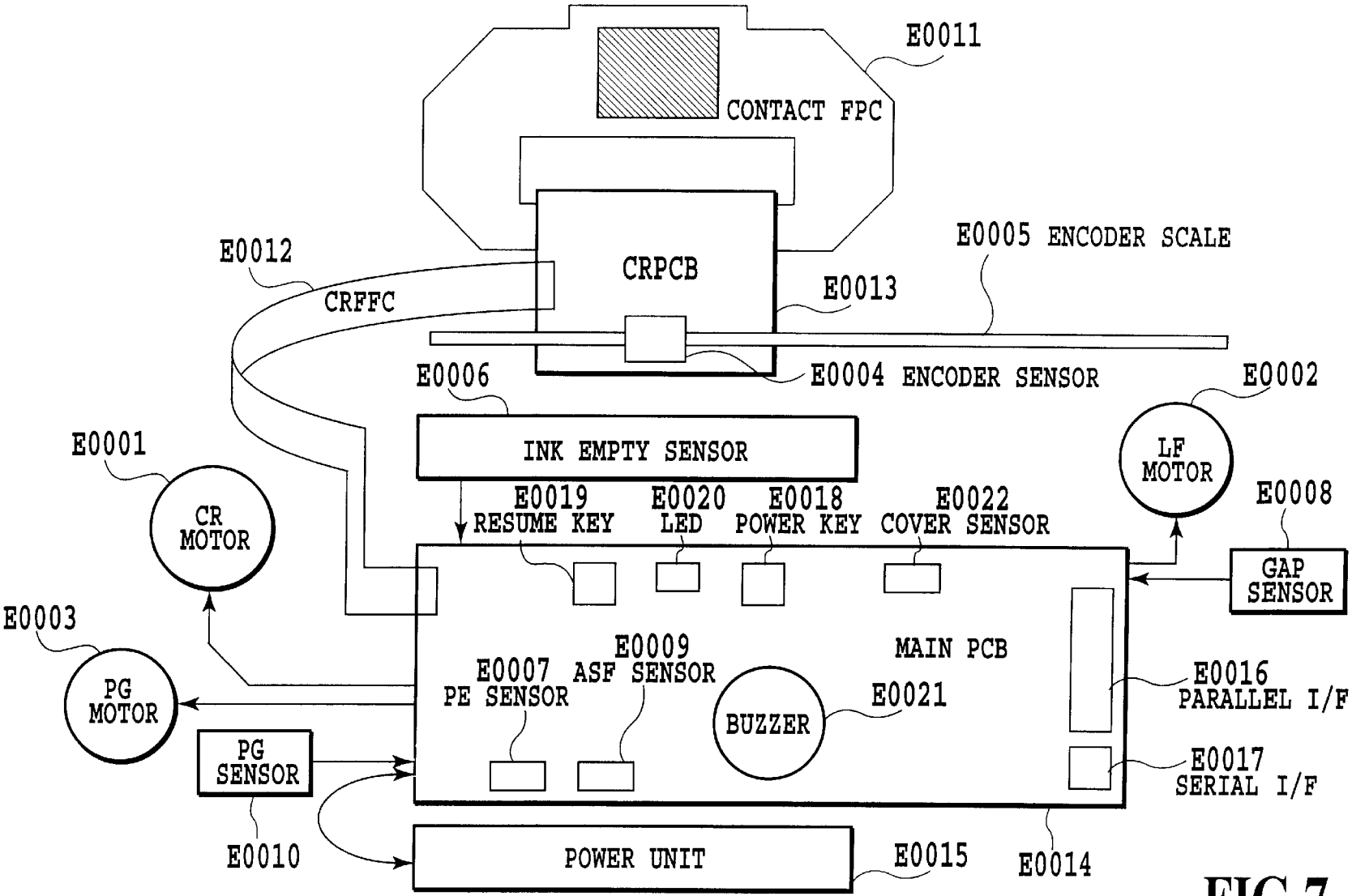
FIG. 7 is a block diagram schematically showing the overall configuration of an electric circuitry of the printer according to one embodiment of the present invention.

FIG. 7 schematically shows the overall configuration of the electric circuit in this embodiment.

The electric circuit in this embodiment comprises mainly a carriage substrate (CRPCB) E0013, a main PCB (printed circuit board) E0014 and a power supply unit E0015.

The power supply unit E0015 is connected to the main PCB E0014 to supply a variety of drive power.

The carriage substrate E0013 is a printed circuit board unit mounted on the carriage M4001 (FIG. 2) and functions as an interface for transferring signals to and from the print head through the contact FPC E0011. In addition, based on a pulse signal output from an encoder sensor E0004 as the carriage M4001 moves, the carriage substrate E0013 detects a change in the positional relation between an encoder scale E0005 and the encoder sensor E0004 and sends its output signal to the main PCB E0014 through a flexible flat cable (CRFFC) E0012.

Further, the main PCB E0014 is a printed circuit board unit that controls the operation of various parts of the ink jet printing apparatus in this embodiment, and has I/O ports for a paper end sensor (PE sensor) E0007, an automatic sheet feeder (ASF) sensor E0009, a cover sensor E0022, a parallel interface (parallel I/F) E0016, a serial interface (Serial I/F) E0017, a resume key E0019, an LED E0020, a power key E0018 and a buzzer E0021. The main PCB E0014 is connected to and controls a motor (CR motor) E0001 that constitutes a drive source for moving the carriage M4001 in the main scan direction; a motor (LF motor) E0002 that constitutes a drive source for transporting the printing medium; and a motor (PG motor) E0003 that performs the functions of recovering the ejection performance of the print head and feeding the printing medium. The main PCB E0014 also has connection interfaces with an ink empty sensor E0006, a gap sensor E0008, a PG sensor E0010, the CRFFC E0012 and the power supply unit E0015.

Figures 8, 8A:
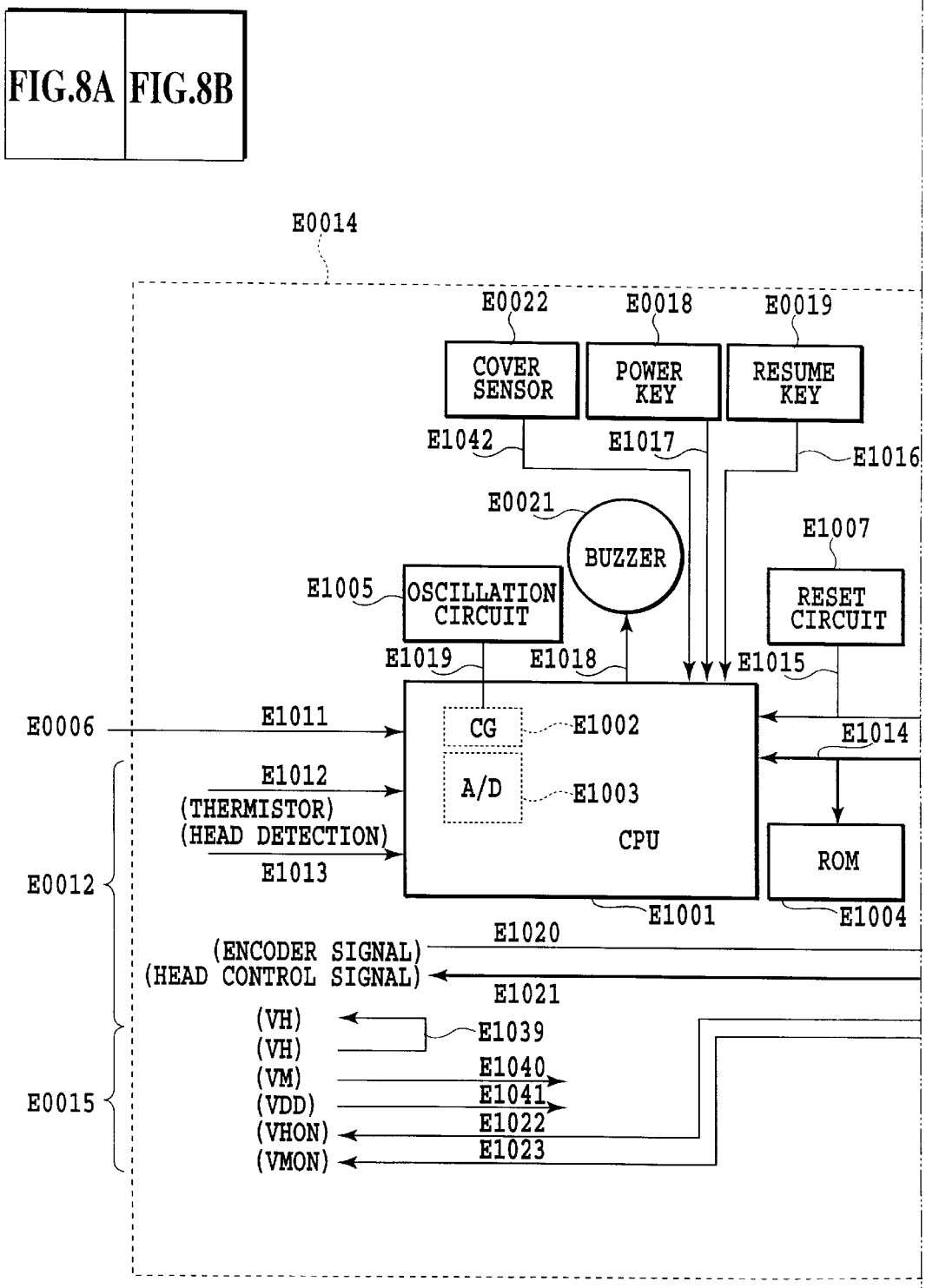
FIG. 8 is a diagram showing the relation between FIGS. 8A and 8B, FIGS. 8A and 8B being block diagrams representing an example inner configuration of a main printed circuit board (PCB) in the electric circuitry of FIG. 7.
Figure 8B:
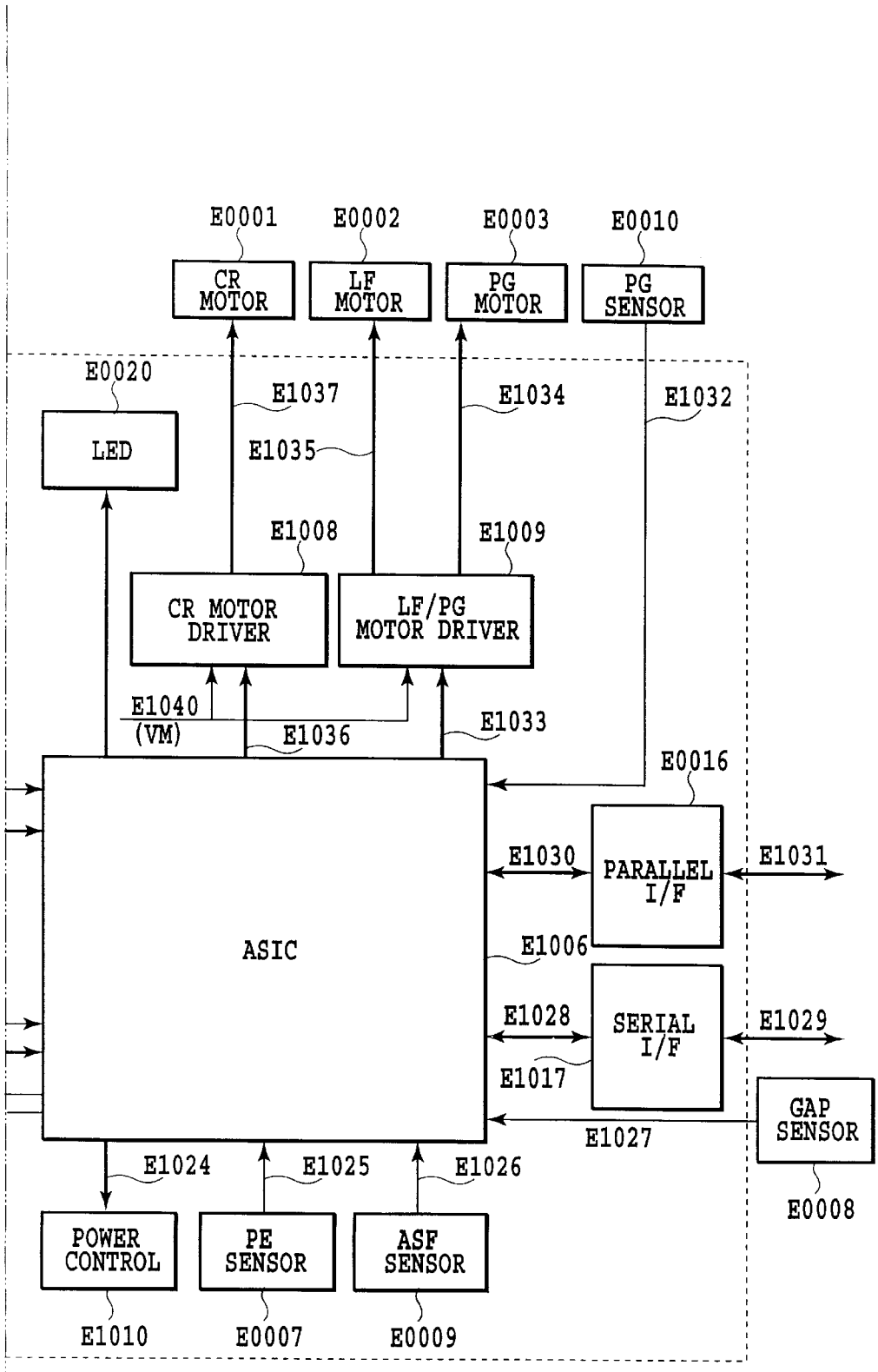

FIG. 8 is a diagram showing the relation between FIGS. 8A and 8B, and FIGS. 8A and 8B are block diagrams showing an inner configuration of the main PCB E0014.

Reference number E1001 represents a CPU, which has a clock generator (CG) E1002 connected to an oscillation circuit E1005 to generate a system clock based on an output signal E1019 of the oscillation circuit E1005. The CPU E1001 is connected to an ASIC (application specific integrated circuit) and a ROM E1004 through a control bus E1014. According to a program stored in the ROM E1004, the CPU E1001 controls the ASIC E1006, checks the status of an input signal E1017 from the power key, an input signal E1016 from the resume key, a cover detection signal E1042 and a head detection signal (HSENS) E1013, drives the buzzer E0021 according to a buzzer signal (BUZ) E1018, and checks the status of an ink empty detection signal (INKS) E1011 connected to a built-in A/D converter E1003 and of a temperature detection signal (TH) E1012 from a thermistor. The CPU E1001 also performs various other logic operations and makes conditional decisions to control the operation of the ink jet printing apparatus.

The head detection signal E1013 is a head mount detection signal entered from the print head cartridge H1000 through the flexible flat cable E0012, the carriage substrate E0013 and the contact FPC E0011. The ink empty detection signal E1011 is an analog signal output from the ink empty sensor E0006. The temperature detection signal E1012 is an analog signal from the thermistor (not shown) provided on the carriage substrate E0013.

Designated E1008 is a CR motor driver that uses a motor power supply (VM) E1040 to generate a CR motor drive signal E1037 according to a CR motor control signal E1036 from the ASIC E1006 to drive the CR motor E0001. E1009 designates an LF/PG motor driver which uses the motor power supply E1040 to generate an LF motor drive signal E1035 according to a pulse motor control signal (PM control signal) E1033 from the ASIC E1006 to drive the LF motor. The LF/PG motor driver E1009 also generates a PG motor drive signal E1034 to drive the PG motor.

Designated E1010 is a power supply control circuit which controls the supply of electricity to respective sensors with light emitting elements according to a power supply control signal E1024 from the ASIC E1006. The parallel I/F E0016 transfers a parallel I/F signal E1030 from the ASIC E1006 to a parallel I/F cable E1031 connected to external circuits and also transfers a signal of the parallel I/F cable E1031 to the ASIC E1006. The serial I/F E0017 transfers a serial I/F signal E1028 from the ASIC E1006 to a serial I/F cable E1029 connected to external circuits, and also transfers a signal from the serial I/F cable E1029 to the ASIC E1006.

The power supply unit E0015 provides a head power signal (VH) E1039, a motor power signal (VM) E1040 and a logic power signal (VDD) E1041. A head power ON signal (VHON) E1022 and a motor power ON signal (VMON) E1023 are sent from the ASIC E1006 to the power supply unit E0015 to perform the ON/OFF control of the head power signal E1039 and the motor power signal E1040. The logic power signal (VDD) E1041 supplied from the power supply unit E0015 is voltage-converted as required and given to various parts inside or outside the main PCB E0014.

The head power signal E1039 is smoothed by a circuit of the main PCB E0014 and then sent out to the flexible flat cable EQ011 to be used for driving the print head cartridge H1000. E1007 denotes a reset circuit which detects a reduction in the logic power signal E1041 and sends a reset signal (RESET) to the CPU E1001 and the ASIC E1006 to initialize them.

The ASIC E1006 is a single-chip semiconductor integrated circuit and is controlled by the CPU E1001 through the control bus E1014 to output the CR motor control signal E1036, the PM control signal E1033, the power supply control signal E1024, the head power ON signal E1022 and the motor power ON signal E1023. It also transfers signals to and from the parallel interface E0016 and the serial interface E0017. In addition, the ASIC E1006 detects the status of a PE detection signal (PES) E1025 from the PE sensor E0007, an ASF detection signal (ASFS) E1026 from the ASF sensor E0009, a gap detection signal (GAPS) E1027 from the GAP sensor E0008 for detecting a gap between the print head and the printing medium, and a PG detection signal (PGS) E1032 from the PG sensor E001O, and sends data representing the statuses of these signals to the CPU E1001 through the control bus E1014. Based on the data received, the CPU E1001 controls the operation of an LED drive signal E1038 to turn.on or off the LED E0020.

Further, the ASIC E1006 checks the status of an encoder signal (ENC) E1020, generates a timing signal, interfaces with the print head cartridge H1000 and controls the print operration by a head control signal E1021. The encoder signal (ENC) E1020 is an output signal of the CR encoder sensor E0004 received through the flexible flat cable E0012. The head control signal E1021 is sent to the print head H1001 through the flexible flat cable E0012, carriage substrate E0013 and contact FPC E0011.

Figures 9, 9A:
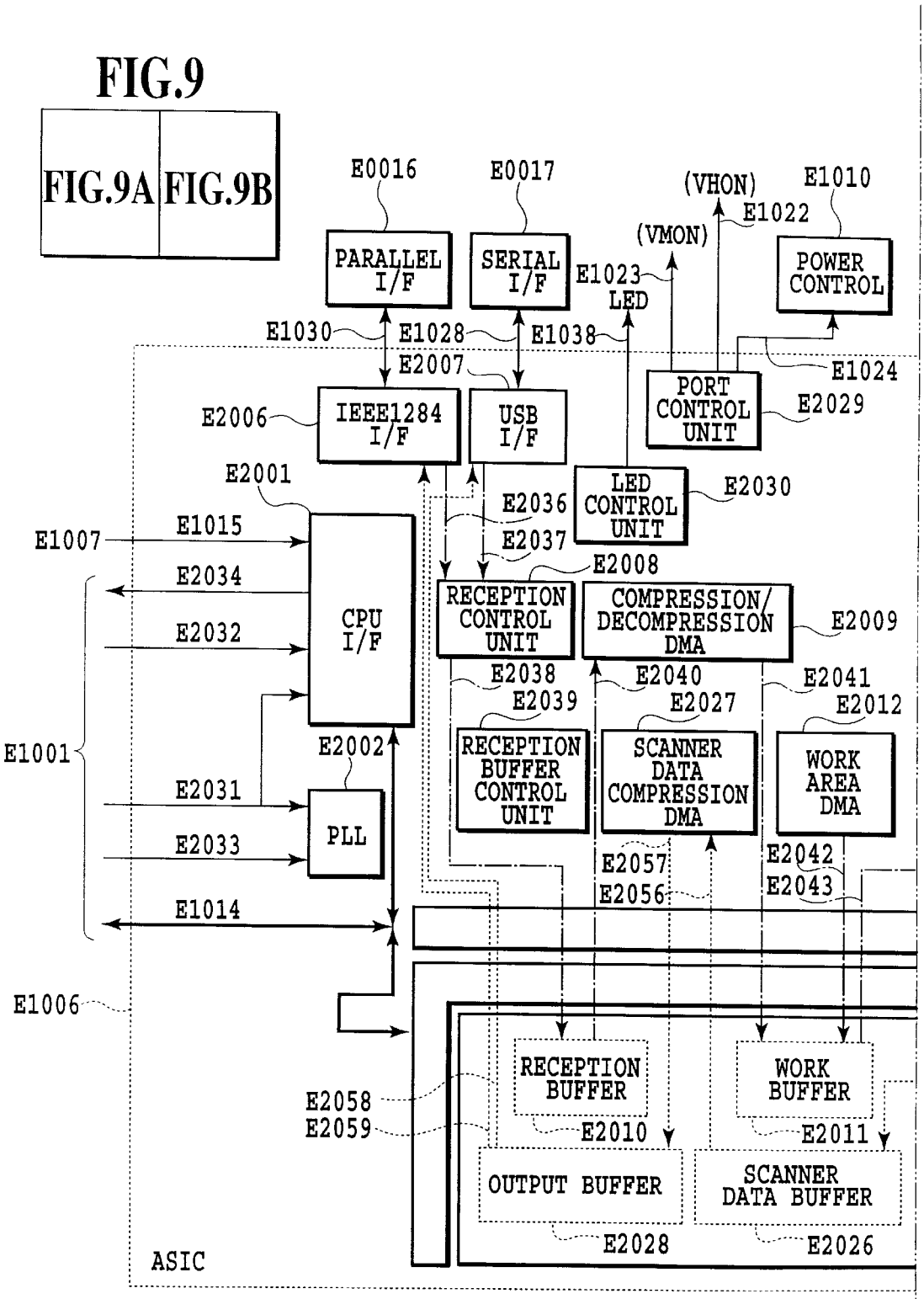
FIG. 9 is a diagram showing the relation between FIGS. 9A and 9B, FIGS. 9A and 9B being block diagrams representing an example inner configuration of an application specific integrated circuit (ASIC) in the main PCB of FIGS. 8A and 8B.
Figure 9B:
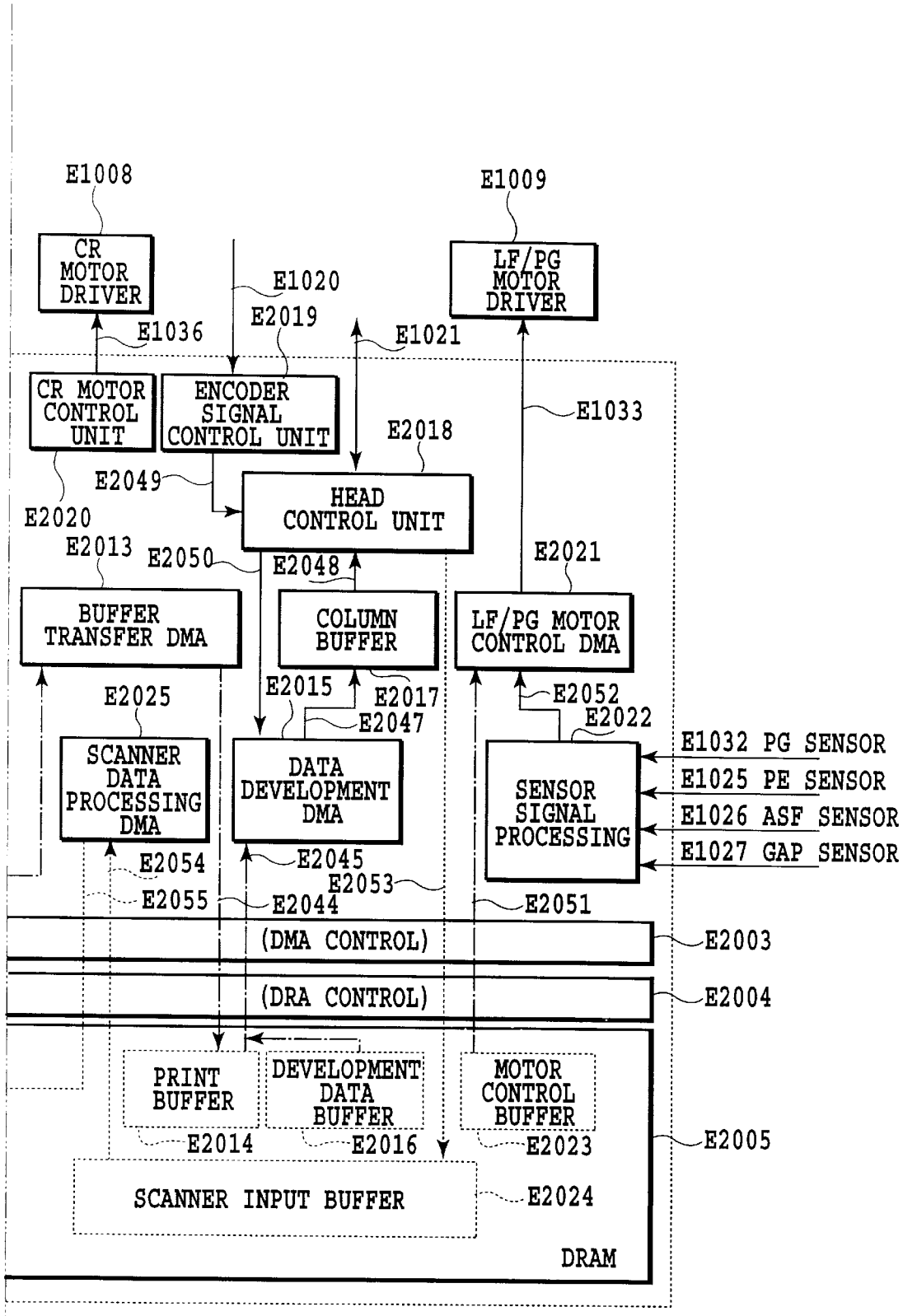

FIG. 9 is a diagram showing the relation between FIGS. 9A and 9B, and FIGS. 9A and 9B are block diagrams showing an example internal configuration of the ASIC E1006.

In these figures, only the flow of data, such as print data and motor control data, associated with the control of the head and various mechanical components is shown between each block, and control signals and clock associated with the read/write operation of the registers incorporated in each block and control signals associated with the DMA control are omitted to simplify the drawing.

In the figures, reference number E2002 represents a PLL controller which, based on a clock signal (CLK) E2031 and a PLL control signal (PLLON) E2033 output from the CPU E1001, generates a clock (not shown) to be supplied to the most part of the ASIC E1006.

Denoted E2001 is a CPU interface (CPU I/F) E2001, which controls the read/write operation of register in each block, supplies a clock to some blocks and accepts an interrupt signal (none of these operations are shown) according to a reset signal E1015, a software reset signal (PDWN) E2032 and a clock signal (CLK) E2031 output from the CPU E1001, and control signals from the control bus E1014. The CPU I/F E2001 then outputs an interrupt signal (INT) E2034 to the CPU E1001 to inform it of the occurrence of an interrupt within the ASIC E1006.

E2005 denotes a DRAM which has various areas for storing print data, such as a reception buffer E2010, a work buffer E2011, a print buffer E2014 and a development data buffer E2016. The DRAM E2005 also has a motor control buffer E2023 for motor control and, as buffers used instead of the above print data buffers during the scanner operation mode, a scanner input buffer E2024, a scanner data buffer E2026 and an output buffer E2028.

The DRAM E2005 is also used as a work area by the CPU E1001 for its, own operation. Designated E2004 is a DRAM control unit E2004 which performs read/write operations on the DRAM E2005 by switching between the DRAM access from the CPU E1001 through the control bus and the DRAM access from a DMA control unit E2003 described later.

The DMA control unit E2003 accepts request signals (not shown) from various blocks and outputs address signals and control signals (not shown) and, in the case of write operation, write data E2038, E2041, E2044, E2053, E2055, E2057 etc. to the DRAM control unit to make DRAM accesses. In the case of read operation, the DMA control unit E2003 transfers the read data E2040, E2043, E2045, E2051, E2054, E2056, E2058, E2059 from the DRAM control unit E2004 to the requesting blocks.

Denoted E2006 is an IEEE 1284 I/F which functions as a bi-directional communication interface with external host devices, not shown, through the parallel I/F E0016 and is controlled by the CPU E1001 via CPU I/F E2001. During the printing operation, the IEEE 1284 I/F E2006 transfers the receive data (PIF receive data E2036) from the parallel I/F E0016 to a reception control unit E2008 by the DMA processing. During the scanner reading operation, the 1284 I/F E2006 sends the data (1284 transmit data (RDPIF) E2059) stored in the output buffer E2028 in the DRAM E2005 to the parallel I/F E0016 by the DMA processing.

Designated E2007 is a universal serial bus (USB) I/F which offers a bi-directional communication interface with external host devices, not shown, through the serial I/F E0017 and is controlled by the CPU E1001 through the CPU I/F E2001. During the printing operation, the universal serial bus (USB) I/F E2007 transfers received data (USB receive data E2037) from the serial I/F E0017 to the reception control unit E2008 by the DMA processing. During the scanner reading, the universal serial bus (USB) I/F E2007 sends data (USB transmit data (RDUSB) E2058) stored in the output buffer E2028 in the DRAM E2005 to the serial I/F E0017 by the DMA processing. The reception control unit E2008 writes data (WDIF E2038) received from the 1284 I/F E2006 or universal serial bus (USB) I/F E2007, whichever is selected, into a reception buffer write address managed by a reception buffer control unit E2039. Designated E2009 is a compression/decompression DMA controller which is controlled by the CPU E1001 through the CPU I/F E2001 to read received data (raster data) stored in a reception buffer E2010 from a reception buffer read address managed by the reception buffer control unit E2039, compress or decompress the data (RDWK) E2040 according to a specified mode, and write the data as a print code string (WDWK) E2041 into the work buffer area.

Designated E2013 is a print buffer transfer DMA controller which is controlled by the CPU E1001 through the CPU I/F E2001 to read print codes (RDWP) E2043 on the work buffer E2011 and rearrange the print codes onto addresses on the print buffer E2014 that match the sequence of data transfer to the print head cartridge H1000 before transferring the codes (WDWP E2044). Reference number E2012 denotes a work area DMA controller which is controlled by the CPU E1001 through the CPU I/F E2001 to repetitively write specified work fill data (WDWF) E2042 into the area of the work buffer whose data transfer by the print buffer transfer DMA controller E2013 has been completed.

Designated E2015 is a print data development DMA controller E2015, which is controlled by the CPU E1001 through the CPU I/F E2001. Triggered by a data development timing signal E2050 from a head control unit E2018, the print data development DMA controller E2015 reads the print code that was rearranged and written into the print buffer and the development data written into the development data buffer E2016 and writes developed print data (RDHDG) E2045 into the column buffer E2017 as column buffer write data (WDHDG) E2047. The column buffer E2017 is an SRAM that temporarily stores the transfer data (developed print data) to be sent to the print head cartridge H1000, and is shared and managed by both the print data development DMA CONTROLLER and the head control unit through a handshake signal (not shown).

Designated E2018 is a head control unit E2018 which is controlled by the CPU E1001 through the CPU I/F E2001 to interface with the print head cartridge H1000 or the scanner through the head control signal. It also outputs a data development timing signal E2050 to the print data development DMA controller according to a head drive timing signal E2049 from the encoder signal processing unit E2019.

During the printing operation, the head control unit E2018, when it receives the head drive timing signal E2049, reads developed print data (RDHD) E2048 from the column buffer and outputs the data to the print head cartridge H1000 as the head control signal E1021.

In the scanner reading mode, the head control unit E2018 DMA-transfers the input data (WDHD) E2053 received as the head control signal E1021 to the scanner input buffer E2024 on the DRAM E2005. Designated E2025 is a scanner data processing DMA controller E2025 which is controlled by the CPU E1001 through the CPU I/F E2001 to read input buffer read data (RDAV) E2054 stored in the scanner input buffer E2024 and writes the averaged data (WDAV) E2055 into the scanner data buffer E2026 on the DRAM E2005.

Designated E2027 is a scanner data compression DMA controller which is controlled by the CPU E1001 through the CPU I/F E2001 to read processed data (RDYC) E2056 on the scanner data buffer E2026, perform data compression, and write the compressed data (WDYC) E2057 into the output buffer E2028 for transfer.

Designated E2019 is an encoder signal processing unit which, when it receives an encoder signal (ENC), outputs the head drive timing signal E2049 according to a mode determined by the CPU E1001. The encoder signal processing unit E2019 also stores in a register information on the position and speed of the carriage M4001 obtained from the encoder signal E1020 and presents it to the CPU E1001. Based on this information, the CPU E1001 determines various parameters for the CR motor E0001. Designated E2020 is a CR motor control unit which is controlled by the CPU E1001 through the CPU I/F E2001 to output the CR motor control signal E1036.

Denoted E2022 is a sensor signal processing unit which receives detection signals E1032, E1025, E1026 and E1027 output from the PG sensor E0010, the PE sensor E0007, the ASF sensor E0009 and the gap sensor E0008, respectively, and transfers these sensor information to the CPU E1001 according to the mode determined by the CPU E1001. The sensor signal processing unit E2022 also outputs a sensor detection signal E2052 to a DMA controller E2021 for controlling LF/PG motor.

The DMA controller E2021 for controlling LF/PG motor is controlled by the CPU E1001 through the CPU I/F E2001 to read a pulse motor drive table (RDPM) E2051 from the motor control buffer E2023 on the DRAM E2005 and output a pulse motor control signal E1033. Depending on the operation mode, the controller outputs the pulse motor control signal E1033 upon reception of the sensor detection signal as a control trigger.

Designated E2030 is an LED control unit which is controlled by the CPU E1001 through the CPU I/F E2001 to output an LED drive signal E1038. Further, designated E2029 is a port control unit which is controlled by the CPU E1001 through the CPU I/F E2001 to output the head power ON signal E1022, the motor power ON signal E1023 and the power supply control signal E1024.

5. Operation of Printer

Figure 10:
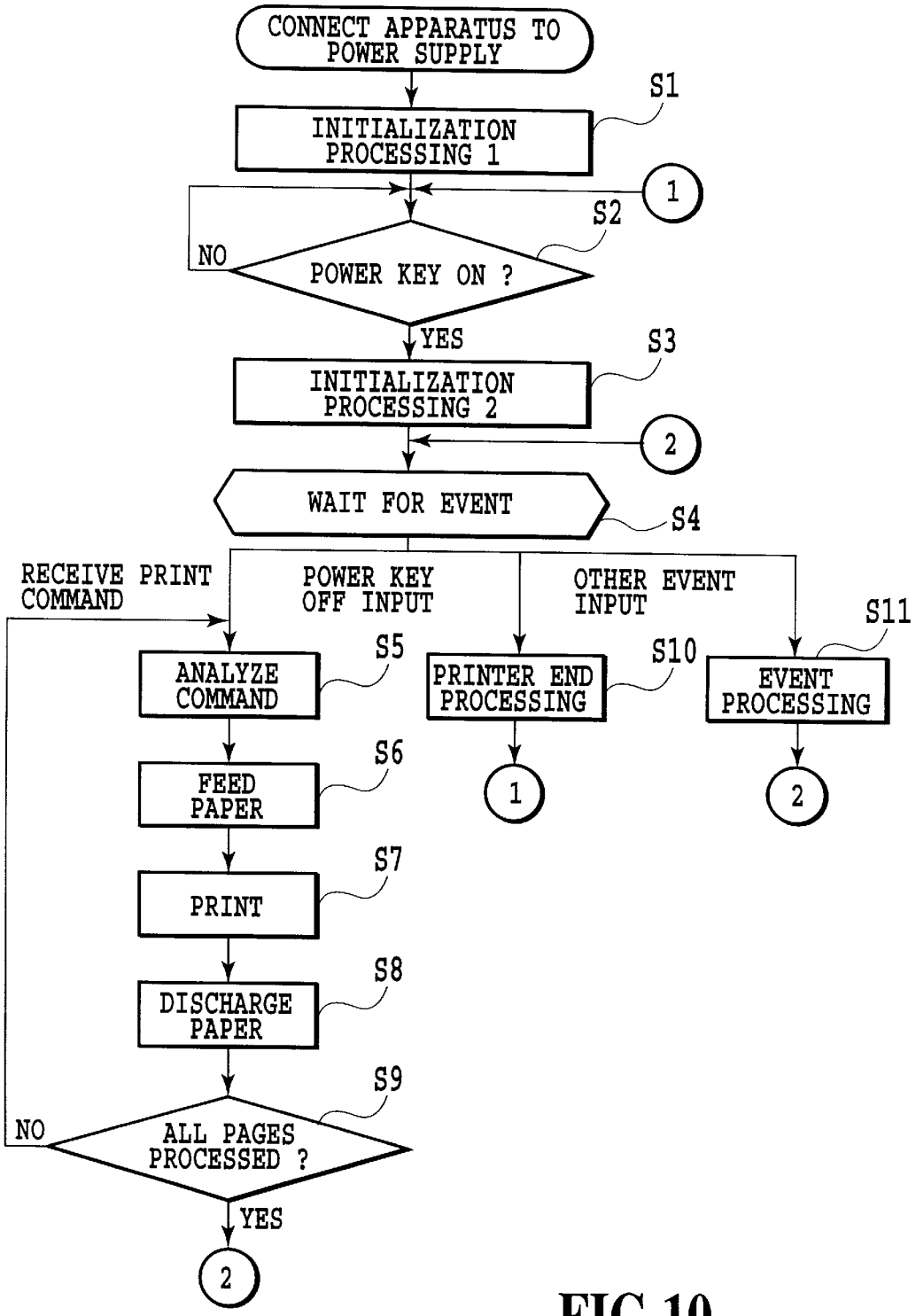
FIG. 10 is a flow chart showing an example of operation of the printer as one embodiment of the present invention.

Next, the operation of the ink jet printing apparatus in this embodiment of the invention with the above configuration will be explained by referring to the flow chart of FIG. 10.

When the printer body M1000 is connected to an AC power supply, a first initialization is performed at step S1. In this initialization process, the electric circuit system including the ROM and RAM in the apparatus is checked to confirm that the apparatus is electrically operable.

Next, step S2 checks if the power key E0018 on the upper case M1002 of the printer body M1000 is turned on. When it is decided that the power key E0018 is pressed, the processing moves to the next step S3 where a second initialization is performed.

In this second initialization, a check is made of various drive mechanisms and the print head of this apparatus. That is, when various motors are initialized and head information is read, it is checked whether the apparatus is normally operable.

Next, steps S4 waits for an event. That is, this step monitors a demand event from the external I/F, a panel key event from the user operation and an internal control event and, when any of these events occurs, executes the corresponding processing.

When, for example, step S4 receives a print command event from the external I/F, the processing moves to step S5. When a power key event from the user operation occurs at step S4, the processing moves to step S10. If another event occurs, the processing moves to step Sll.

Step S5 analyzes the print command from the external I/F, checks a specified paper kind, paper size, print quality, paper feeding method and others, and stores data representing the check result into the DRAM E2005 of the apparatus before proceeding to step S6.

Next, step S6 starts feeding the paper according to the paper feeding method specified by the step S5 until the paper is situated at the print start position. The processing moves to step S7.

At step S7 the printing operation is performed. In this printing operation, the print data sent from the external I/F is stored temporarily in the print buffer. Then, the CR motor E0001 is started to move the carriage M4001 in the main-scanning direction. At the same time, the print data stored in the print buffer E2014 is transferred to the print head H1001 to print one line. When one line of the print data has been printed, the LF motor E0002 is driven to rotate the LF roller M3001 to transport the paper in the sub-scanning direction. After this, the above operation is executed repetitively until one page of the print data from the external I/F is completely printed, at which time the processing moves to step S8.

At step S8, the LF motor E0002 is driven to rotate the paper discharge roller M2003 to feed the paper until it is decided that the paper is completely fed out of the apparatus, at which time the paper is completely discharged onto the paper discharge tray M1004.

Next at step S9, it is checked whether all the pages that need to be printed have been printed and if there are pages that remain to be printed, the processing returns to step S5 and the steps S5 to S9 are repeated. When all the pages that need to be printed have been printed, the print operation is ended and the processing moves to step S4 waiting for the next event.

Step S10 performs the printing termination processing to stop the operation of the apparatus. That is, to turn off various motors and print head, this step renders the apparatus ready to be cut off from power supply and then turns off power, before moving to step S4 waiting for the next event.

Step S11 performs other event processing. For example, this step performs processing corresponding to the ejection performance recovery command from various panel keys or external I/F and the ejection performance recovery event that occurs internally. After the recovery processing is finished, the printer operation moves to step S4 waiting for the next event.

Next, some embodiments of a printer including an ink tank as a liquid container according to the present invention will be described with reference to the drawings.

(First Embodiment)

Figure 11A:
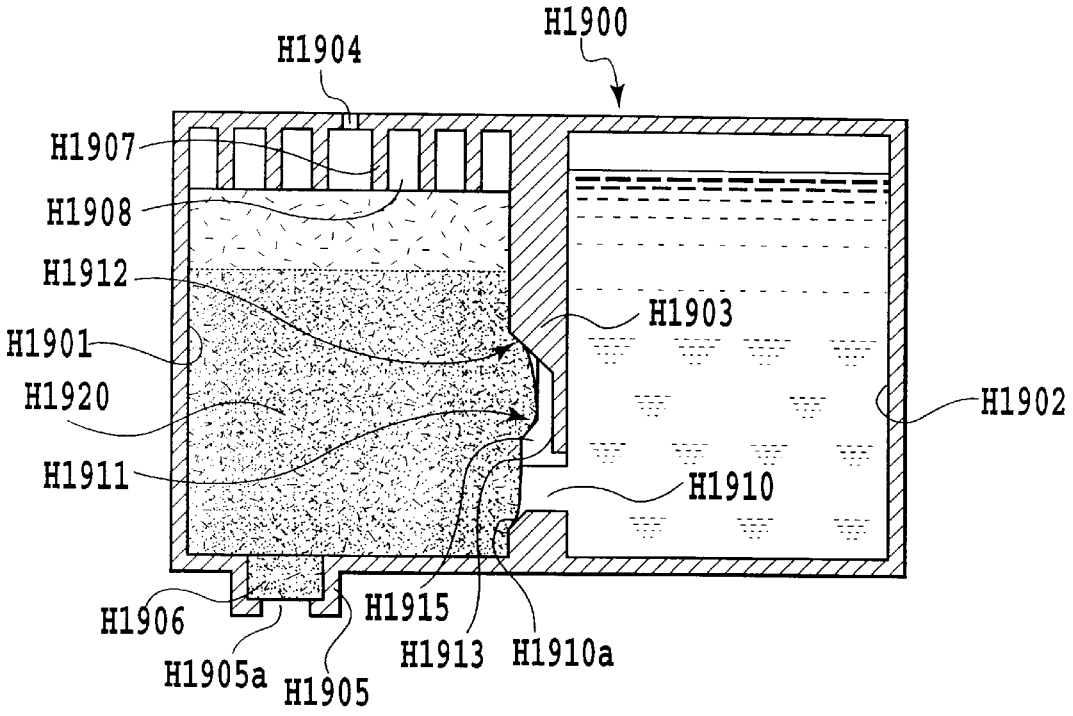
Figure 11B:
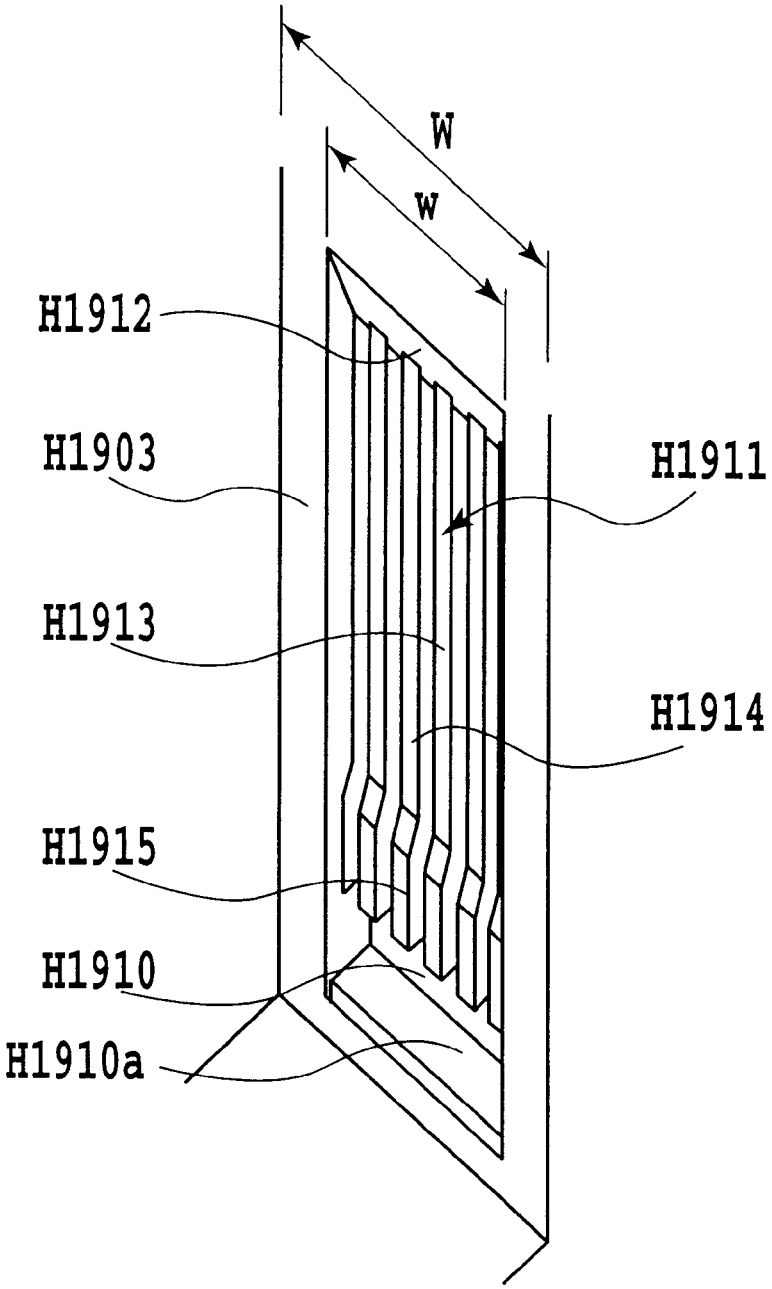

FIGS. 11A and 11B show the first embodiment of an ink tank of an ink cartridge or the like the best illustrating particular feature of the printer according to the present invention, in which FIG. 11A is a longitudinal section of the ink tank, and FIG. 11B is a perspective view showing an atmospheric air introducing portion of the ink tank.

The ink tank for the printer in accordance with the present invention will be described hereinafter in terms of the ink tank such as an ink cartridge.

As shown in FIGS. 11A and 11B, in the first embodiment of the ink tank as the liquid container in the printer according to the present invention, ink tank H1900 is separated into a negative pressure generating member containing chamber H1901 and a liquid containing chamber H1902 by a partition wall H1903 of a predetermined thickness. The negative pressure generating member containing chamber H1901 and the liquid containing chamber H1902 are communicated with each other through a communicating opening H1910 provided in the lower portion (on the bottom side in the shown first embodiment) of the partition wall H1903. In the negative pressure generating member containing chamber H1901, a negative pressure generating member H1920, such as a fibrous absorbing body constituted of olef in type resin such as polyethylene or the like, fiber of other appropriate resin and so on, is received. In the liquid containing chamber H1902, a liquid such as an ink is received. It should be noted that the negative pressure generating member H1920 is formed by stacking fibrous bodies consisted of fiber having substantially the same directionality. The direction of the fiber is intersecting with a direction along a surface of the partition wall H1903. On the other hand, it is preferred that the communication opening H1910 provided in the partition wall H1903 separating the ink tank H1900 into the negative pressure generating member containing chamber H1901 and the liquid containing chamber H1902, is appropriately cut out or chamfered to form a tilted portion H1910*a* at the lower portion on the side of the negative pressure generating member containing chamber H1901, for providing insertion stability of the negative pressure generating member.

Furthermore, in a top wall of the negative pressure generating member containing chamber H1901 of the ink tank H1900, an atmosphere communication opening H1904 as an atmosphere communicating portion is provided. On the inner side of the top wall, a plurality of ribs H1907 depending downwardly are provided with an interval. Between the ribs H1907, a plurality of buffer chambers H1908 are formed. In the bottom portion of the negative pressure generating member containing chamber H1901, a supply tube H1905 formed with a supply opening H1905*a* at the end for supplying ink to a printing head H1001 (FIG. 3) is provided. A pressure contact body H1906 such as an ink leading member is filled within the supply tube H1905. Accordingly, the supply opening H1905*a* is constructed so as to be connected with the printing head H1001, by engagement, for example.

In the partition wall H1903 of the ink tank H1900, an atmospheric air introducing portion H1911 including a pressure contact buffering portion H1912 for the negative pressure generating member, is formed at a position immediately above the lower communicating opening H1910. The atmospheric air introducing portion H1911 is formed with a plurality of vertically extending atmospheric air introducing grooves H1913. These atmospheric air introducing grooves H1913 are defined between a plurality of ridge portions H1914. Projecting portions H1915 are provided at the lower position of the ridge portions H1914. With a height difference between the surface of the partition wall H1903 and the pressure contact buffering portion H1912, increasing of density of the negative pressure generating member H1920 in the vicinity of the pressure contact buffering portion H1912 is reduced. In conjunction therewith, the projecting portions H1915 serves for preventing formation of an extra space so as to restrict formation of bubble accumulation. The pressure contact buffering portion H1912 can be formed by processing the corresponding portion of the partition wall H1903 by spot facing or other methods.

A portion around the atmospheric air introducing portion H1911 including the buffering portion H1912, which reduces an contact area at high pressure, for the negative pressure generating member H1920 is shown in detail in FIG. 11B in an enlarged form. Namely, as shown in FIG. 11B, the atmospheric air introducing portion H1911 includes a pressure contact buffering portion H1912 of a width "w" formed at the center of the partition wall H1903 of a width "W" in a width direction by a process, such as spot facing or the like and a plurality of atmospheric air introducing grooves H1913 defined inwardly between the ridge portions H1914. The positional relationship in the depth direction from the surface of the partition wall H1903 is to step down in order of the surface of the projecting portion H1915, the surface of the ridge portion H1914 and the bottom surface of the atmospheric air introducing groove H1913. Accordingly, a contact area of the negative pressure generating member H1920, such as a fibrous absorbing body or the like, is reduced by the pressure contact buffering portion H1911 in comparison with the case where the negative pressure generating member H1920 contacts with the entire surface of the partition wall H1903, so that contact pressure is buffered to restrict formation of the high density portion. On the other hand, by the form provided with the projections H1915 at the lower portion of the ridges H1914 in the atmospheric air introducing portion H1911, formation of bubble accumulation is restricted. When the negative pressure generating member H1920 is inserted from the upper portion of the receptacle chamber H1901 upon assembling of the liquid container H1900, the negative pressure generating member H1920 which is partially expanded once in the pressure contact buffering portion H1912 is returned to the height substantially matching with the height of the surface of the partition wall H1903 and is guided to the tilted portion H1910*a* of the partition wall H1903 below the communication opening H1910. On the other hand, as shown in FIG. 11B, the pressure contact buffering portion H1912 provided with the projecting portion H1915 at the lower portion is recessed down from the surface of the partition wall H1903. By this, the negative pressure generating member H1920 is formed into a shape contacting with the partition wall H1903 at both ends to expand or extend toward the center portion.

(Second Embodiment)

Figure 12:
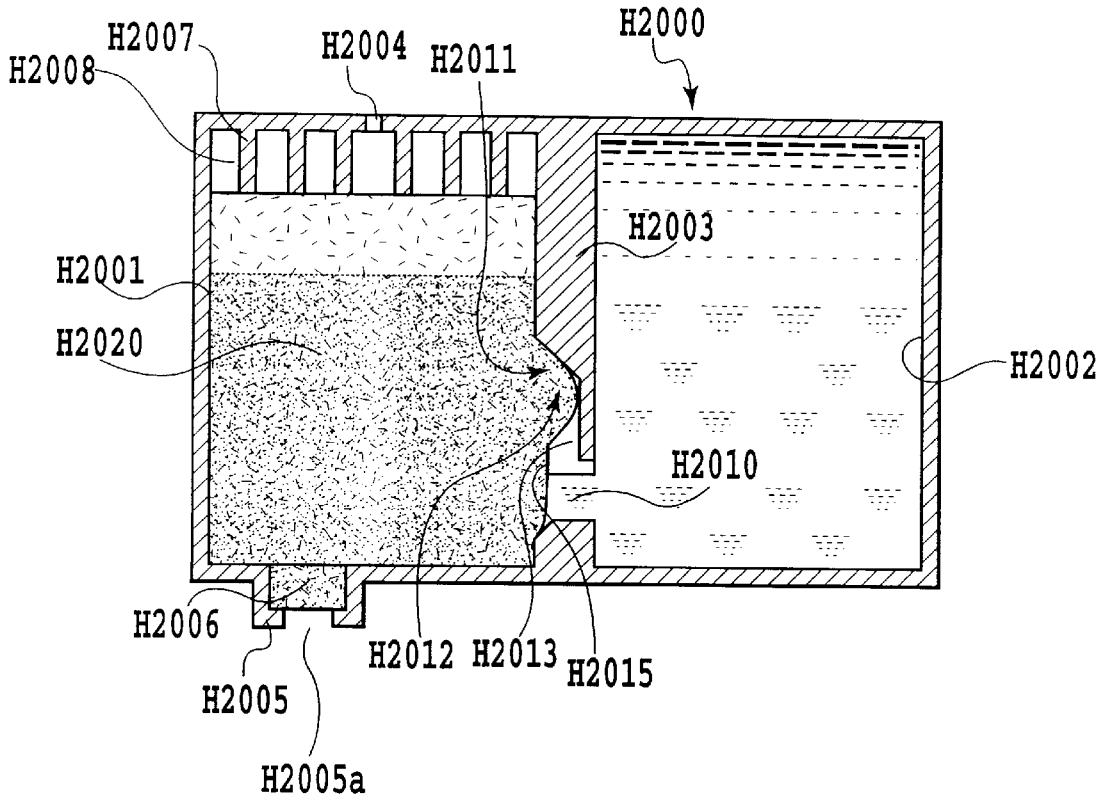
FIG. 12 is a longitudinal section of the second embodiment of an ink tank in a printing apparatus according to the present invention.

FIG. 12 is a general section similar to FIG. 11A and showing the second embodiment of the ink tank as the liquid container in the printer according to the present invention.

As shown, even in the shown embodiment, similarly to the former first embodiment, a pressure contact buffer portion H2012 for buffering pressure contact of a negative pressure generating member H2020 is provided. However, the structure of the pressure contact buffering portion H2012 is differentiated by omitting the upper portion of a plurality of vertically extending atmospheric air introducing grooves H2013. Namely, in a certain restricted condition of elasticity of negative pressure generating member H2020 or of thickness of partition wall H2003 and others, it is impossible that the grooves are arranged in buffering portion H2012. Even in such case, if a large space is not formed in the buffering portion H2012, bubbles will never grow. Therefore, the grooves at the relevant portion set forth above can be omitted.

In the second embodiment, an ink tank H2000 is separated into a negative pressure generating member containing chamber H2001 and a liquid containing chamber H2002 by the partition wall H2003. By a communication opening H2010 provided at the lower portion of the partition wall H2003, on the bottom side in the shown second embodiment, the negative pressure generating member containing chamber H2001 and the liquid containing chamber H2002 are communicated with each other. In the negative pressure generating member containing chamber H2001, the negative pressure generating member H2020, such as a fibrous absorbing body constituted of fiber of olef in type resin, such as polyethylene or the like, is received. In the liquid containing chamber H2002, a liquid such as an ink is stored.

Furthermore, in the top wall of the negative pressure generating member containing chamber H2001 of the ink tank H2000, an atmosphere communication opening H2004 as the atmosphere communicating portion is provided. On the inner side of the top wall, a plurality of ribs H2007 are provided with a given interval. A plurality of buffering chambers H2008 are defined between the ribs H2007. On the other hand, in the bottom portion of the negative pressure generating member containing chamber H2001, a supply tube H2005 formed with a supply openings H2005*a* at the end portion for supplying the ink to the printing head H1001 (FIG. 3). In the supply tube H2005, a pressure contact body H2006, such as an ink leading member is filled. Accordingly, the supply opening H2005*a* is connected with the printing head H1001 by engagement, for example.

Immediately above the communication opening H2010 of the partition wall H2003 of the ink tank H2000, the atmospheric air introducing portion H2011 including the pressure contact buffering portion H2012 for the negative pressure generating member is formed. In the shown second embodiment, projecting portions H2015 are provided corresponding to the projecting portions H1915 with omitting a part of the atmospheric air introducing grooves by removing the upper portion of the ridge portions H1914 in the first embodiment. BY a height difference between the surface of the partition wall H2003 and the pressure contact buffering portion H2012, increasing of density of the negative pressure generating member H2020 in the vicinity of the pressure contact buffering portion H2012 is buffered. In conjunction therewith, by the projecting portion H2015, the extra space is not formed to restrict formation of bubble accumulation. It is similar to the first embodiment to form the buffering portion H2012 by processing the corresponding portion of the partition wall H2003 into recessed form by the known method.

(Third Embodiment)

Figure 13:
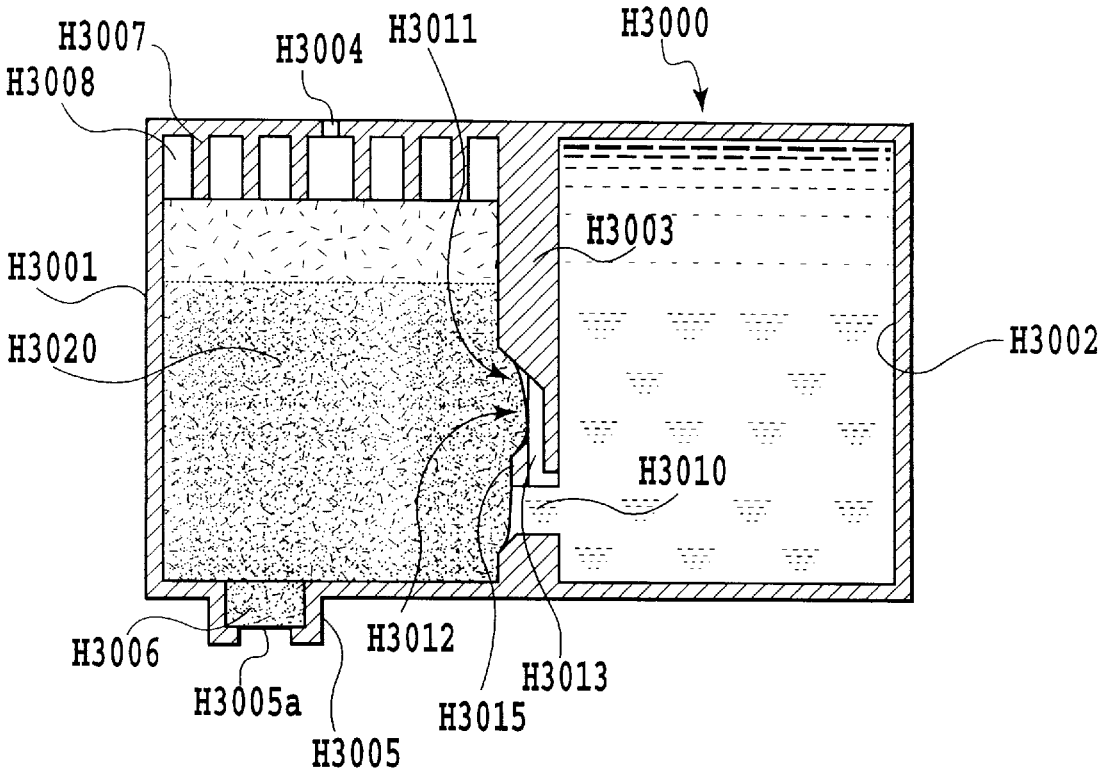
FIG. 13 is a longitudinal section of the third embodiment of an ink tank in a printing apparatus according to the present invention.
Figure 14A:
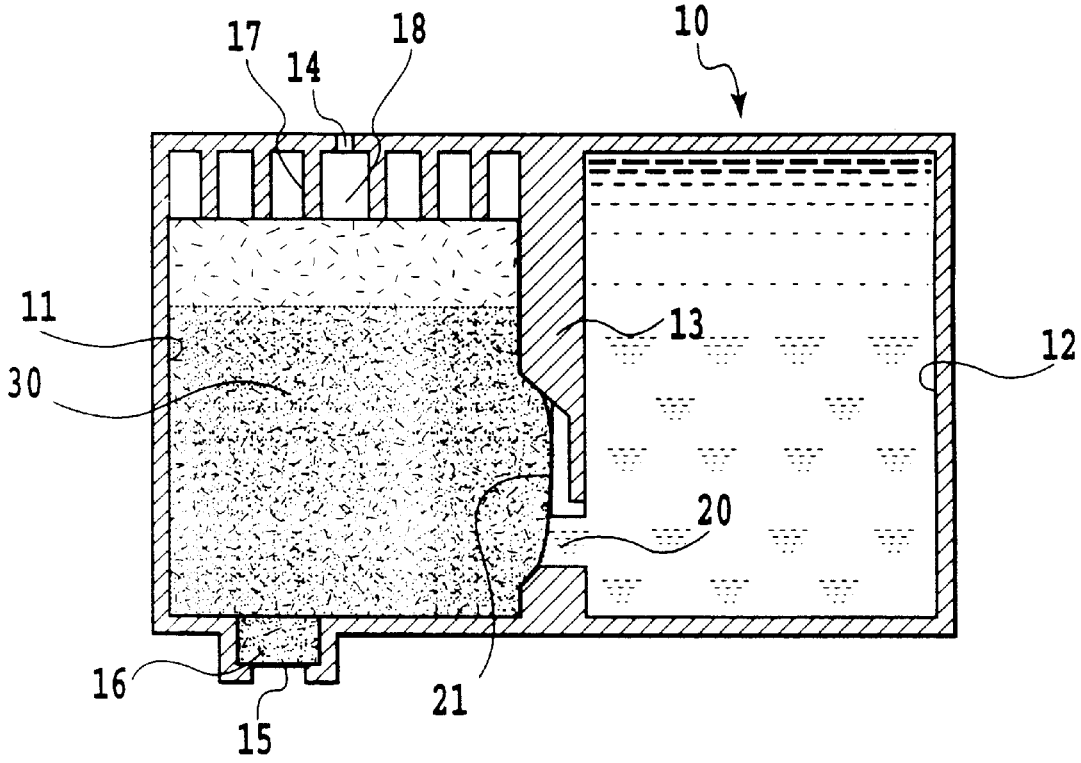
FIG.14A PRIOR ART
Figure 14B:
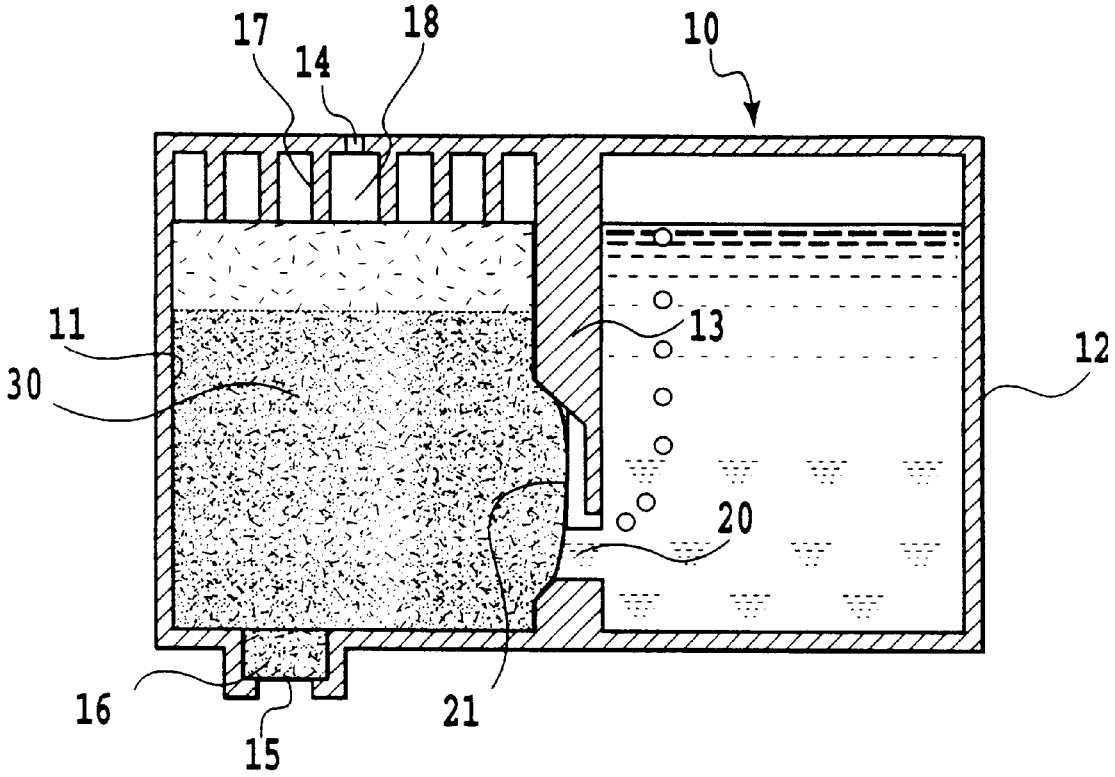
FIG.14B PRIOR ART
Figure 15A:
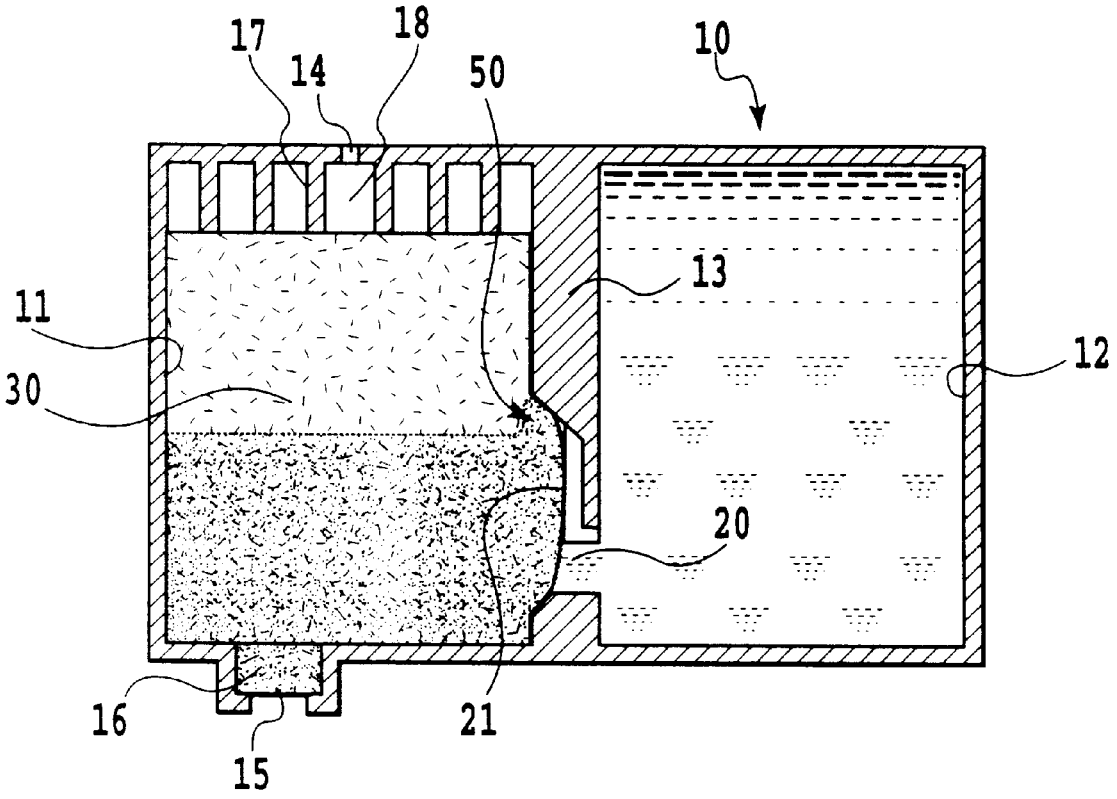
FIG.15A PRIOR ART
Figure 15B:
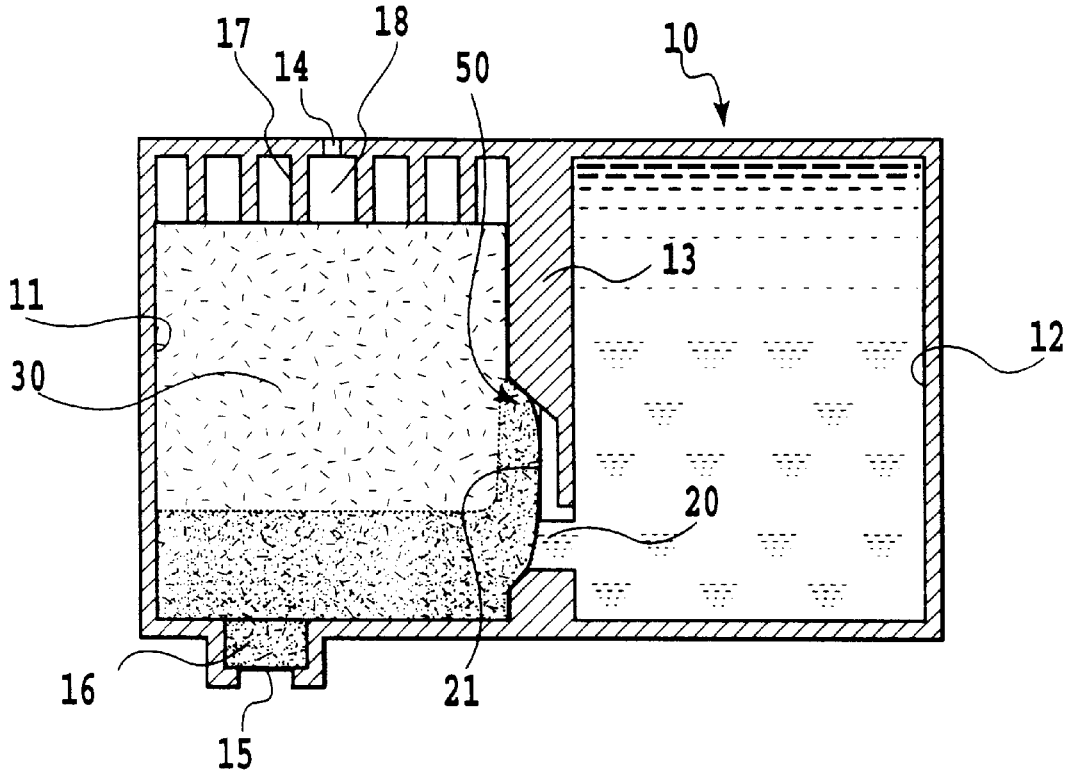
FIG.15B PRIOR ART
Figure 16:
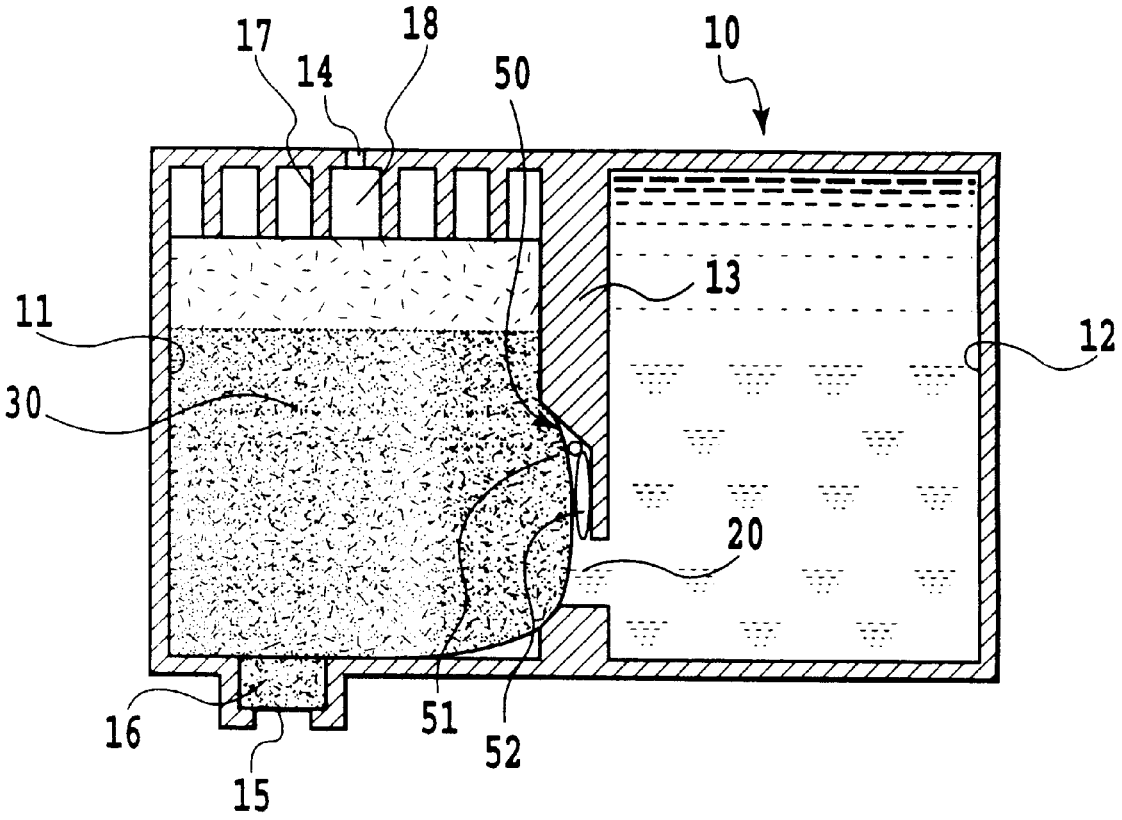
FIG.16 PRIOR ART
FIG. 16 is a longitudinal section of an ink tank for explaining the supply failure in the ink tank of the conventional printer.

FIG. 13 is a general section showing the third embodiment of the ink tank as the liquid container in the printer according to the present invention.

In the third embodiment, the lower portion of an atmospheric air introducing portion H3011 is formed into a shape having tubes instead of grooves. With this, different from the former embodiment, when a negative pressure generating member H3020 is inserted into a negative pressure generating member containing chamber H3001 and guided by a projecting portion H3015, a surface of the negative pressure generating member H3020 is not disturbed by the surface of the projecting portion H3015. Moreover, a possibility of plugging of an atmospheric air introducing portion H3011 by penetration of a fraction of the negative pressure generating member H3020 into grooves, such as the atmospheric air introducing grooves or the like, can be eliminated.

Namely, similar to the former embodiments, an ink tank H3000 is separated into a negative pressure generating member containing chamber H3001 and a liquid containing chamber H3002 by a partition wall H3003. By a communication opening H3010 provided at the lower portion of the partition wall H3003, the negative pressure generating member containing chamber H3001 and the liquid containing chamber H3002 are communicated with each other. In the negative pressure generating member containing chamber H3001, the negative pressure generating member H3020, such as a fibrous absorbing body constituted of fiber of olefin type resin, such as polyethylene or the like, is received. In the liquid containing chamber H3002, a liquid such as an ink is stored.

Furthermore, in the top wall of the negative pressure generating member containing chamber H3001 of the ink tank H3000, an atmosphere communication opening H3004 as the atmosphere communicating portion is provided. On the inner side of the top wall, a plurality of ribs H3007 are provided with a given interval. A plurality of buffering chambers H3008 are defined between the ribs H3007. On the other hand, in the bottom portion of the negative pressure generating member containing chamber H3001, a supply tube H3005 formed with a supply openings H3005*a* at the end portion for supplying the ink to the printing head H1001. In the supply tube H3005, a pressure contact body H3006, such as the ink leading member is filled. Accordingly, the supply opening H3005*a* is connected with the printing head H1001 by engagement, for example.

Immediately above the communication opening H3010 of the partition wall H3003 of the ink tank H3000, the atmospheric air introducing portion H3011 including the pressure contact buffering portion H3012 for the negative pressure generating member is formed. In the shown third embodiment, a projecting portion H3015 is provided in such a manner that a surface of the projecting portion H3015 is formed by continuing the surface portions of the projecting portions H1915 in the first embodiment. BY height difference between the surface of the partition wall H3003 and the pressure contact buffering portion H3012, increasing of density of the negative pressure generating member H3020 in the vicinity of the pressure contact buffering portion H3012 is buffered. In conjunction therewith, by the projecting portion H3015, an extra space is not formed to restrict formation of bubble accumulation. It is similar to the first embodiment to form the buffering portion H3012 by processing the corresponding portion of the partition wall H3003 into recessed form by the known method.

Since the lower portion of the atmospheric air introducing portion H3011 is formed into the tubes instead of the grooved shape, when the negative pressure generating member H3020 is guided by the projecting portion H3015 as inserted from the above into the negative pressure generating member containing chamber H3001, the surface of the negative pressure generating member H3020 may not be disturbed for absence of unevenness in the projecting portion H3015.

In the above embodiments, although the construction is disclosed that the projecting portion provided within the atmospheric air introducing portion or mechanism, which is recessed in the partition wall, is formed immediately above the communicating opening, it may also be possible to form the projecting portion well above the communicating opening. However, it is preferred to provide the projecting portion at least adjacent to the communicating opening taking the function of the projecting portion into account. On the other hand, although the construction is disclosed that the height of the projecting portion provided within the recessed atmospheric air introducing portion or mechanism having a predetermined depth is less than the predetermined depth, it may also be possible that the height of the projecting portion is equal to or higher than the predetermined depth of the recessed atmospheric air introducing portion or mechanism. However, it is preferred that the height of the projecting portion is equal to or lower than the predetermined depth of the recessed atmospheric air introducing mechanism taking the function of the projecting portion into account.

By constructed as set forth above, even when the negative pressure generating member formed of fiber having low elastic modules is used as the negative pressure generating member in the ink tank, difference of density is hardly caused in the negative pressure generating member by contacting the negative pressure generating member on the partition wall to restrict occurrence of ink supply failure due to local excessive capillary force. Accordingly, the ink in the ink tank can be efficiently spent out. Therefore, the ink tank which can perform stable ink supply, can be obtained.

One aspect, in which the present invention can be used effectively is the form by forming a bubble generated by film boiling in the liquid utilizing thermal energy generated by an electrothermal transducer.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A liquid container comprising:

a negative pressure generating member containing chamber receiving a negative pressure generating member formed with a fibrous material and having a liquid supply portion and an atmosphere communicating portion;

a liquid containing chamber forming a substantially enclosed space having a communicating portion communicating with said negative pressure generating member containing chamber and storing a liquid to be supplied to said negative pressure generating member;

a partition wall separating said negative pressure generating member containing chamber and said liquid containing chamber and formed with said communicating portion;

an atmospheric air introducing mechanism in a surface of said partition wall which faces said negative pressure generating member containing chamber, said atmospheric air introducing mechanism allowing atmospheric air to be introduced from a negative pressure generating member containing chamber side of said partition wall, said atmospheric air introducing mechanism including a plurality of projecting portions and depressed portions which are arranged in rows from an intermediate portion of said partition wall to said communicating portion, each of said projecting portions including a first projecting portion and a second projecting portion adjacent to said communicating portion of said partition wall, said second projecting portion projecting via an inclined surface from said first projecting portion toward said negative pressure generating member containing chamber; and wherein surfaces of said first and second projecting portions and bottom surfaces of said depressed portions are recessed in a direction toward said liquid containing chamber relative to the surface of said partition wall.

2. A liquid container as claimed in claim 1, wherein a part of said atmospheric air introducing mechanism is tube-shaped.

3. A liquid ejection mechanism comprising a liquid container according to claim 1 and a print head for ejecting ink supplied from said liquid container.

4. An ink jet printing apparatus comprising a carriage for movably supporting a liquid ejecting mechanism according to claim 3.

5. A liquid container as claimed in claim 1, wherein said communicating portion is an opening provided in said partition wall and wherein said partition wall includes a tilted portion adjacent to said opening.

6. A liquid container as claimed in claim 5, wherein said projecting portions act to buffer pressure contact between said negative pressure generating-member onto said partition wall, and wherein said projecting portions and said tilted portion improve workability in assembling when said negative pressure generating member is inserted in said negative pressure generating member containing chamber.

7. A liquid container comprising:

a negative pressure generating member containing chamber receiving a negative pressure generating member formed with a fibrous material and having a liquid supply portion and an atmosphere communicating portion;

a liquid containing chamber forming a substantially enclosed space having a communicating portion communicating with said negative pressure generating member containing chamber and storing a liquid to be supplied to said negative pressure generating member;

a partition wall separating said negative pressure generating member containing chamber and said liquid containing chamber and formed with said communicating portion;

an atmospheric air introducing mechanism in a surface of said partition wall which faces said negative pressure generating member containing chamber, said atmospheric air introducing mechanism allowing atmospheric air to be introduced from a negative pressure generating member containing chamber side of said partition wall, said atmospheric air introducing mechanism including a plurality of projecting portions and depressed portions which are arranged in rows from an intermediate portion of said partition wall to said communicating portion, each of said projecting portions including a first projecting portion and a second projecting portion adjacent to said communicating portion of said partition wall, said second projecting portion projecting via an inclined surface from said first projecting portion toward said negative pressure generating member containing chamber;

wherein said negative pressure generating member is formed with olefin type resin fiber and is formed by stacking fibrous bodies with substantially the same directionality which intersects with said partition wall.

8. A liquid container as claimed in claim 7, wherein a part of said atmospheric air introducing mechanism is tube-shaped.

9. A liquid ejecting mechanism comprising a liquid container according to claim 7 and a print head for ejecting ink supplied from said liquid container.

10. An ink jet printing apparatus comprising a carriage for movably supporting a liquid ejecting mechanism according to claim 9.

11. A liquid container as claimed in claim 7, wherein said communicating portion is an opening provided in said partition wall, and wherein said partition wall includes a tilted portion adjacent to said opening.

12. A liquid container as claimed in claim 11, wherein said projecting portions act to buffer pressure contact between said negative pressure generating-member and said partition wall, and wherein said projecting portions and said tilted portion improve workability in assembling when said negative pressure generating member is inserted in said negative pressure generating member containing chamber.

* * * * *